US007983581B2

(12) United States Patent
Ishigami et al.

(10) Patent No.: US 7,983,581 B2
(45) Date of Patent: Jul. 19, 2011

(54) FIXING METHOD AND FIXING DEVICE WITH SPECIFIED TEMPERATURE RELATIONSHIPS FOR RECORDING MEDIUM

(75) Inventors: Koh Ishigami, Mishima (JP); Hiroyuki Fujikawa, Yokohama (JP); Nobuyoshi Sugahara, Toride (JP); Naoki Okamoto, Mishima (JP); Yoshinobu Baba, Yokohama (JP); Takayuki Itakura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 508 days.

(21) Appl. No.: 10/540,562

(22) PCT Filed: Apr. 26, 2005

(86) PCT No.: PCT/JP2005/007905

§ 371 (c)(1),
(2), (4) Date: Nov. 16, 2005

(87) PCT Pub. No.: WO2005/103837

PCT Pub. Date: Nov. 3, 2005

(65) Prior Publication Data

US 2006/0251451 A1 Nov. 9, 2006

(30) Foreign Application Priority Data

Apr. 26, 2004 (JP) ..... 2004-130276

(51) Int. Cl.
*G03G 15/20* (2006.01)

(52) U.S. Cl. ..... 399/69; 399/328; 399/341

(58) Field of Classification Search ..... 399/69, 399/328, 330, 331, 341
See application file for complete search history.

(56) References Cited

U.S. PATENT DOCUMENTS

| | | | | |
|---|---|---|---|---|
| 6,526,250 | B1 | 2/2003 | Usui et al. | |
| 2002/0102118 | A1 | 8/2002 | Kosugi et al. | |
| 2003/0129518 | A1 | 7/2003 | Sawada et al. | |
| 2003/0180063 | A1 | 9/2003 | Kanesawa et al. | |
| 2003/0180074 | A1 * | 9/2003 | Noya et al. | 399/328 |

(Continued)

FOREIGN PATENT DOCUMENTS

| | | |
|---|---|---|
| JP | 4-287078 | 10/1992 |

(Continued)

OTHER PUBLICATIONS

Partial Translation of JP 11-024466, submitted by e-mail to the office by Gary Jacobs.*

(Continued)

*Primary Examiner* — David M Gray
*Assistant Examiner* — Laura K Roth
(74) *Attorney, Agent, or Firm* — Fitzpatrick, Cella, Harper & Scinto

(57) ABSTRACT

A fixing method and a fixing device is provided in which an unfixed toner image formed on a recording medium is heat-pressure-fixed by using a fixing unit, wherein the unfixed toner image is fixed when the recording medium passes through at least two fixing units arranged in series in a conveying direction of the recording medium. Specific relations are satisfied between a maximum temperature on the recording medium when the recording medium passes through a first fixing unit, a maximum temperature on the recording medium when the recording medium passes through a second fixing unit, a minimum temperature on the recording medium during a time period commencing on ejection of the recording medium from the first fixing unit and ending on entry of the recording medium into the second fixing unit and properties of the toner.

4 Claims, 8 Drawing Sheets

U.S. PATENT DOCUMENTS

| | | | | |
|---|---|---|---|---|
| 2004/0057741 | A1* | 3/2004 | Uehara et al. | 399/341 |
| 2005/0042534 | A1* | 2/2005 | Tanaka et al. | |
| 2005/0135847 | A1* | 6/2005 | Bogoshian | 399/328 |

FOREIGN PATENT DOCUMENTS

| | | |
|---|---|---|
| JP | 10-69186 | 3/1998 |
| JP | 10-293494 | 11/1998 |
| JP | 11-024466 | 1/1999 |
| JP | 11-338287 | 12/1999 |
| JP | 2000-000993 | 1/2000 |
| JP | 2000-221821 | 8/2000 |
| JP | 2000-315034 | 11/2000 |
| JP | 2002-214822 | 7/2002 |
| JP | 2002-365967 | 12/2002 |
| JP | 2003-248395 | 9/2003 |

OTHER PUBLICATIONS

Communication in European Patent Application No. 05737127.0, dated Dec. 17, 2009.

English-language translation of Japanese Office Action dated Feb. 1, 2011, in Japanese Application No. 2005-127607.

* cited by examiner

FIXING DEVICE A

FIXING DEVICE B

FIXING DEVICE C

FIXING DEVICE D

FIXING METHOD AND FIXING DEVICE WITH SPECIFIED TEMPERATURE RELATIONSHIPS FOR RECORDING MEDIUM

TECHNICAL FIELD

The present invention relates to a fixing method and a fixing device for fixing a toner image formed with a developer in electrophotography onto a recording medium.

BACKGROUND ART

It is well known that a silver salt photograph generally has high image gloss, is excellent in image gloss uniformity and color reproducibility, and is excellent in image quality. In addition, the silver salt photograph is characterized by high productivity, and can be printed in a large number per unit time.

Meanwhile, image quality has been steadily increasing in electrophotography owing to digitalization in recent years. However, compatibility between high image gloss uniformity and high productivity has not been achieved yet, so there has been desired a full-color image forming method according to electrophotography in which compatibility is achieved between high image gloss and high productivity. In addition, there has also been desired an image forming method, with which images without a sense of incongruity each of which has image gloss uniformity comparable to that of a silver salt image, and has a balance between image gloss and recording medium gloss can be stably and continuously obtained, at a relatively high recording medium conveying speed while high image gloss and high productivity are made compatible.

As a full-color image forming method according to electrophotography achieving compatibility between high image gloss and high productivity, a high-speed machine which has multiple developing units arranged in series and can output a monochrome image and a full-color image at the same speed has been put on the market. However, when an image having high image gloss is desired, for example, a recording medium conveying speed is reduced to increase image gloss. As a result, productivity has been reduced.

In general, when attention is paid to a fixing step of a copying machine having a relatively high recording medium conveying speed, the time necessary for a recording medium to pass through a fixing unit is relatively short, so a heat quantity to be applied to the recording medium reduces. A reduction in heat quantity to be applied to the recording medium directly leads to a reduction in image gloss. Therefore, an increased heat quantity must be applied in order to obtain an image having high gloss without impairing productivity.

A method of obtaining an image having high image gloss at a relatively high recording medium conveying speed involves: widening a fixation nip; and applying an increased heat quantity to a recording medium. For example, in a roller fixing unit referred to as a roller nip type shown in FIG. 1, fixing members are brought into strong abutment with each other to widen a fixation nip.

In addition, there is a belt nip type fixing device shown in FIG. 2 in which a fixing roller and a conveying and fixing belt are combined ((FIG. 2) shows a technique in which the conveying and fixing belt is combined to widen a nip between the belt and the fixing roller to cope with an increased speed).

Based on the same concept that an increased heat quantity is applied for obtaining an image having high image gloss at a relatively high recording medium conveying speed, there is a device having multiple fixing units arranged as shown in FIG. 3.

Such a device is described in, for example, JP-A 2000-221821 (Patent Document 1). The document describes a method involving: performing fixation by using multiple fixing units arranged in series in a recording medium conveying direction while switching the number of fixing units to be used; and changing a heat quantity to be applied to a recording medium to arbitrarily adjust the gloss of a printed image. With the method, image gloss is adjusted without a reduction in printing speed. However, the document has no description relating to toner physical properties, and has no discussion about the relationship between any one of the toner physical properties and gloss.

A conventionally known example referring to: a fixing device having multiple fixing means; fixing conditions of multiple fixing units; and toner properties includes JP-A 04-287078 (Patent Document 2). The document has proposals regarding a toner softening point and a fixing temperature in a method involving heat-pressure-fixing color toner onto a transparent recording medium, in particular, a heat-pressure-fixing method involving: performing temporary fixation in first fixation; and performing actual fixation in second fixation. However, in the document, recording medium is limited to a transparent recording medium such as an over-head projector sheet, and recording medium conveying speeds in the first fixation and the second fixation is limited to relatively low recording medium conveying speeds, so it does not assume the use in a high-speed machine. Therefore, there remains, for example, a problem in that sufficient transparency cannot be obtained at a relatively high recording medium conveying speed. In addition, the document refers to the set temperature of a fixing unit, but the temperature on a recording medium is not directly measured in the document. In the case of fixation to a recording medium such as paper unlike a transparent medium such as an over-head projector sheet, molten toner flows into a concave portion formed by a fiber of the recording medium, so the image surface becomes uneven and image gloss reduces in some cases. In addition, there is, for example, a problem in that fixation strength becomes insufficient, and color-mixing ability becomes insufficient to result in poor color reproducibility.

As described above, investigations have been made with a view to achieving compatibility between high gloss and high productivity. However, there has been nearly no investigation in which attention is paid to the relationship with any toner physical property. Moreover, no research has been made on a method of obtaining an image without a sense of incongruity which has high gloss uniformity, and has a small difference between recording medium gloss and image gloss at a relatively high recording medium conveying speed.

Patent Document 1: JP-A 2000-221821

Patent Document 2: JP-A 04-287078

DISCLOSURE OF THE INVENTION

An object of the present invention is to provide a fixing method and a fixing device that have solved the above problems.

That is, an object of the present invention is to provide a fixing method and a fixing device with each of which an image which has high gloss that is uniform irrespective of a toner mounting amount on a recording medium can be obtained at a relatively high recording medium conveying speed.

Another object of the present invention is to provide a fixing method and a fixing device with each of which images each having a suppressed sense of difference in gloss between the image and a recording medium can be stably and continuously obtained.

The inventors of the present invention have made extensive studies to find out that the above requirement can be satisfied by adjusting a toner image formed on a recording medium to have a relationship between a temperature on the recording medium that is allowed to pass through a fixing unit at least twice and flow tester property of toner within the range set forth in the present invention, thereby completing the present invention.

That is, according to one aspect of the present invention, there is provided a fixing method, including heat-pressure-fixing an unfixed toner image formed on a recording medium by using fixing means, wherein:

the unfixed toner image is fixed when the recording medium passes through at least 2 fixing units arranged in series in a conveying direction of the recording medium;

a toner for forming the unfixed toner image is a toner containing a release agent; and the following formulas (1) and (2) are satisfied when a maximum temperature on the recording medium when the recording medium passes through a first fixing unit is denoted by T1, a maximum temperature on the recording medium when the recording medium passes through a second fixing unit is denoted by T2, a minimum temperature on the recording medium during a time period commencing on ejection of the recording medium from the first fixing unit and ending on entry of the recording medium into the second fixing unit is denoted by t, a flow tester softening temperature of the toner is denoted by Ts, and a flow starting temperature of the toner is denoted by Tfb.

$$T1>Tfb \quad \text{formula (1)}$$

$$T2>t>Ts \quad \text{formula (2)}$$

In further aspect of the fixing method, when a flow tester ½ method melting temperature of the toner is denoted by $T_{1/2}$, $T_{1/2}$ and T2 satisfy the following formula (3).

$$T2>T_{1/2} \quad \text{formula (3)}$$

In further aspect of the fixing method, the toner has a maximum value of a maximum endothermic peak in the range of 60 to 140° C. in differential scanning calorimetry.

According to another aspect of the present invention, there is provided a fixing device, including fixing means for heat-pressure-fixing an unfixed toner image formed on a recording medium, wherein that:

the unfixed toner image is fixed when the recording medium passes through at least 2 fixing units arranged in series in a conveying direction of the recording medium;

a toner for forming the unfixed toner image is a toner containing a release agent; and the following formulas (1) and (2) are satisfied when a maximum temperature on the recording medium when the recording medium passes through a first fixing unit is denoted by T1, a maximum temperature on the recording medium when the recording medium passes through a second fixing unit is denoted by T2, a minimum temperature on the recording medium during a time period commencing on ejection of the recording medium from the first fixing unit and ending on entry of the recording medium into the second fixing unit is denoted by t, a flow tester softening temperature of the toner is denoted by Ts, and a flow starting temperature of the toner is denoted by Tfb.

$$T1>Tfb \quad \text{formula (1)}$$

$$T2>t>Ts \quad \text{formula (2)}$$

In further aspect of the fixing device, when a flow tester ½ method melting temperature of the toner is denoted by $T_{1/2}$, $T_{1/2}$ and T2 satisfy the following formula (3).

$$T2>T_{1/2} \quad \text{formula (3)}$$

In further aspect of the fixing device, the toner has a maximum value of a maximum endothermic peak in the range of 60 to 140° C. in an endothermic curve in differential scanning calorimetry.

BEST MODE FOR CARRYING OUT THE INVENTION

Hereinafter, the present invention will be described in detail.

Figure 3:
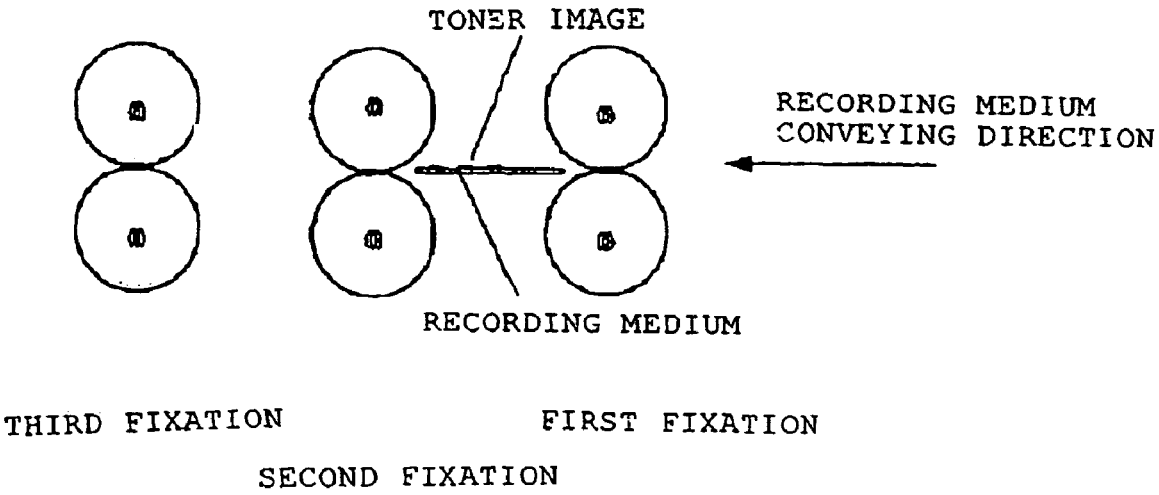
FIG. 3 is a schematic view showing an example of a fixing device of the present invention in which 2 or more fixing units are arranged in series in a recording medium conveying direction.

To explain a fixing device to which the present invention is applied, FIG. 3 shows a schematic view of the device.

The fixing device shown in FIG. 3 has 3 fixing units having the same function arranged in series in a sheet conveying direction. Here, the respective fixing units are referred to as a first fixing unit, a second fixing unit, and a third fixing unit from the upstream side of a recording medium conveying direction indicated by an arrow in the figure. When fixation is performed by using the fixing device, a recording medium carrying an unfixed toner image enters a nip portion of the first fixing unit, and is sandwiched and conveyed while being heated and pressurized, followed by being subjected to a primary fixation treatment. Subsequently, the recording medium is sandwiched and conveyed while being heated and pressurized by a nip portion of the second fixing unit, followed by being subjected to a secondary fixation treatment. Furthermore, the recording medium is subjected to a tertiary fixation treatment. The fixing device having 3 fixing units has been exemplified, but a fixing device having 2 or more fixing units has only to be used in the present invention. Therefore, the present invention is not limited to the number and kinds of fixing units shown in the fixing device of FIG. 3.

The fixing unit set forth in the present invention is not limited at all as long as it is a heat-pressure-fixing type fixing device.

Figure 1:
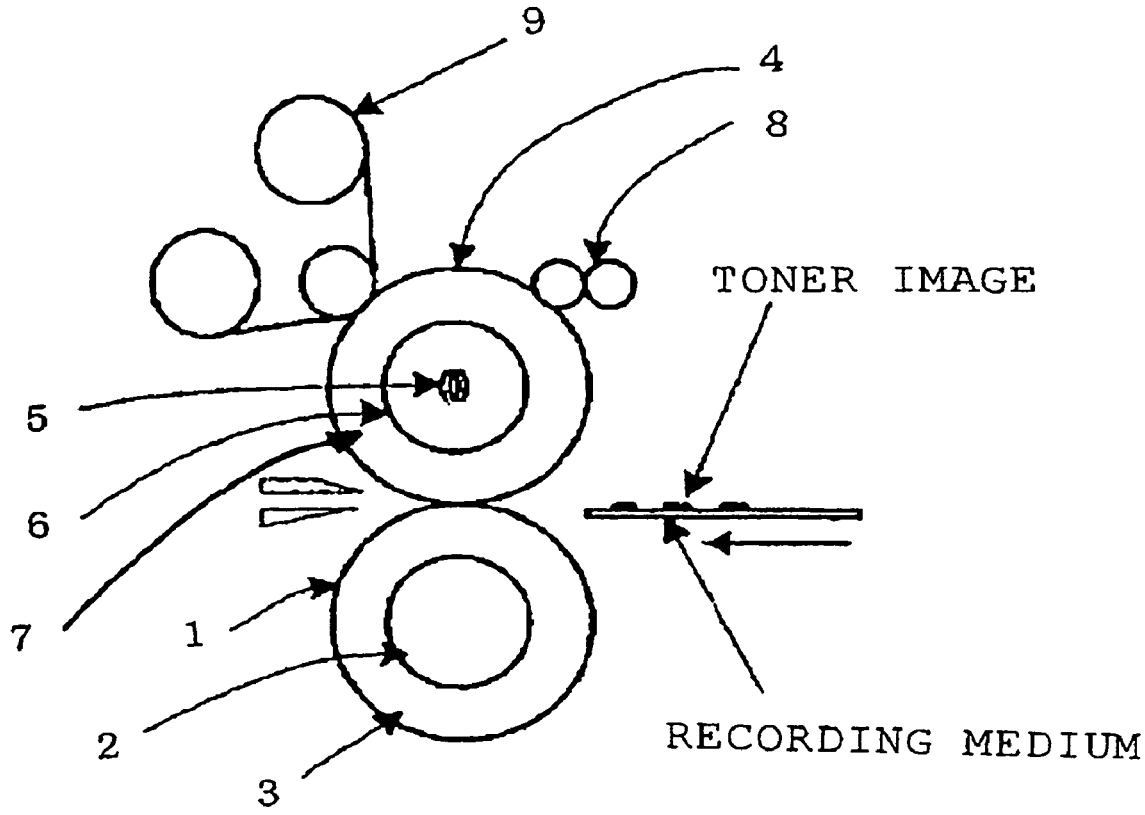
FIG. 1 is a schematic view showing an example of a fixing unit referred to as a roller nip type of the present invention.

FIG. 1 shows an example of a roller nip type fixing unit. A pressurizing roller 1 is constructed by coating a cored bar 2 made of aluminum with a resin surface layer 3 which is made of a fluorine resin or the like, has heat resistance, and has good releasability. A fixing roller 4 is constructed by: a cored bar 5 having a heater in it; an under layer 6 made of soft silicone rubber (or silicone sponge) having heat resistance, the under layer being formed on the cored bar; and a coating layer 7 coated with a PFA tube (or FEP tube), the coating layer being formed on the under layer. Thus, the fixing roller has enhanced toner releasability. An oil supply roller 8 for applying silicone oil to the fixing roller 4 may be arranged near the fixing roller 4. In addition, in FIG. 1, a cleaning device 9 for removing residual toner or paper powder on the fixing roller 4 is arranged near the fixing roller 4.

Figure 2:
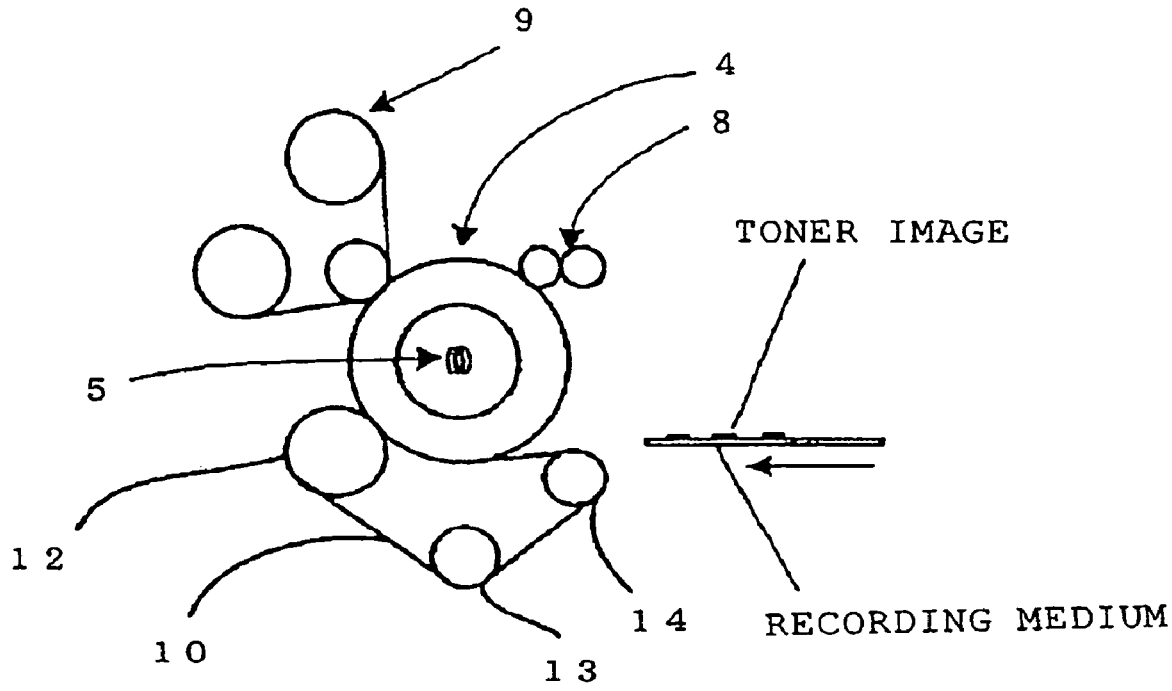
FIG. 2 is a schematic view showing an example of a fixing unit referred to as a belt nip type of the present invention.

Such a belt nip type fixing unit as shown in FIG. 2 may be used. In the belt nip type fixing unit, the fixing roller 4 and a conveying and fixing belt 10 form a wide fixing nip portion. A pressurizing roll 12 is pressed against the fixing roller 4 via the belt 10, and the belt is pressed against the fixing roller to form a wide nip portion. In FIG. 2, the conveying and fixing belt is wound around a support roll 13 and a driving roll 14.

A film fixing type fixing unit may also be used. In the film fixing type fixing unit, at a nip portion formed by a film and a pressurizing member, the back side of the film is provided with a heating member, and an unfixed toner image formed on a transfer material is fixed by being pressed against the heating member by the heating member via the film.

According to the present invention, there is provided a fixing method, including heat-pressure-fixing an unfixed toner image formed on a recording medium by using fixing means, characterized in that: in order to fix the toner image formed on the recording medium, the unfixed toner image is fixed when the recording medium passes through at least 2 fixing units arranged in series in a conveying direction of the recording medium; and the following formulas (1) and (2) are satisfied when a maximum temperature on the recording medium when the recording medium passes through a first fixing unit is denoted by T1, a maximum temperature on the recording medium when the recording medium passes through a second fixing unit is denoted by T2, a minimum temperature on the recording medium during a time period commencing on ejection of the recording medium from the first fixing unit and ending on entry of the recording medium into the second fixing unit is denoted by t, a flow tester softening temperature of the toner is denoted by Ts, and a flow starting temperature of the toner is denoted by Tfb.

$$T1>Tfb \qquad \text{formula (1)}$$

$$T2>t>Ts \qquad \text{formula (2)}$$

According to the fixing method of the present invention, an image having high gloss that is uniform irrespective of a toner mounting amount on a recording medium can be obtained at a relatively high recording medium conveying speed. In addition, even when a recording medium having high gloss is used, images each having a suppressed sense of difference in gloss between the image and a recording medium can be stably and continuously obtained.

Figure 4:
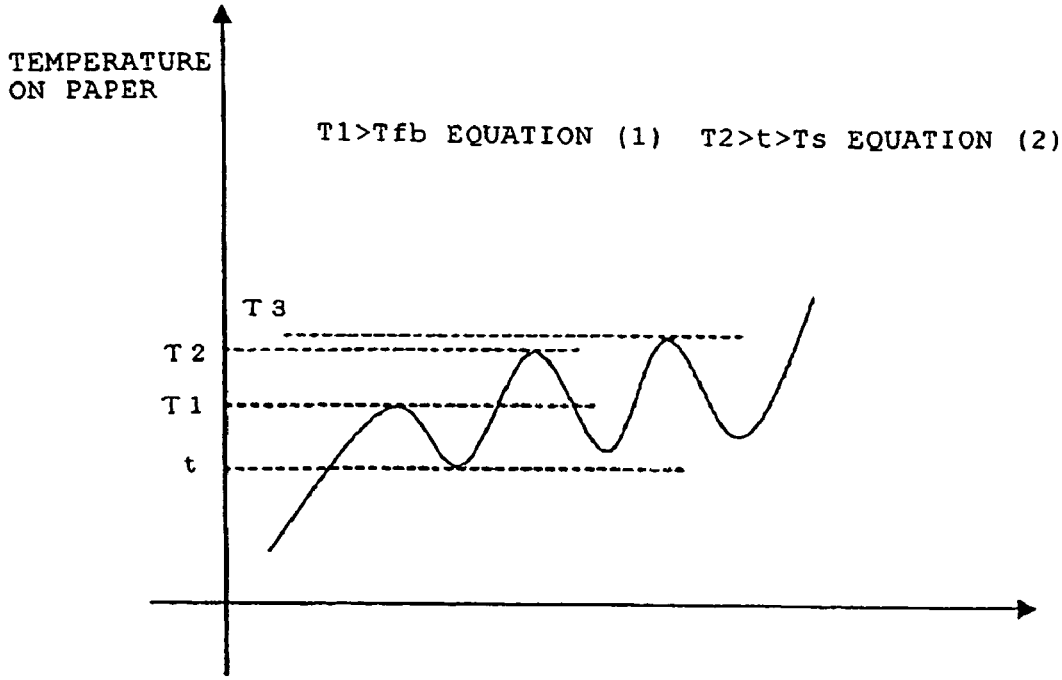
FIG. 4 is a schematic view showing a transition in temperature on a recording medium that is allowed to pass through the fixing device of the present invention.

The temperature on a recording medium is recorded by: attaching, to the surface (surface to be heated) of the recording medium (basic weight 157 (g/m$^2$) coat paper), a high-speed responsive thermocouple (SE80117 (tip line diameter 50 μm), manufactured by Anritsu-Meter) at a position downstream by 50 mm of the tip portion of the recording medium to enter a fixing unit first; and allowing the recording medium to pass through 2 or more fixing units. FIG. 4 shows a maximum temperature on the recording medium before and after the recording medium passes through a fixing unit and a minimum temperature on the recording medium during a time period commencing on ejection of the recording medium from a fixing unit and ending on entry of the recording medium into another fixing unit defined in the present invention, and a transition in temperature on the recording medium when the recording medium is allowed to pass through the fixing device shown in FIG. 3.

First, description is given of the fact that the gloss of an image can be enhanced by using 2 or more fixing units.

In the case where the toner contains a release agent, the toner is heated to Tfb or higher at the time when the recording medium passes through the first fixing unit. Thus, on a microscopic scale, the reagglomeration of the release agent occurs, the dispersion diameter of the release agent increases, and the release agent exudes to the outermost surface of the toner image. Furthermore, releasability of the recording medium from the fixing member increases at the time when the recording medium passes through the second fixing unit owing to the release agent that has exuded to the outermost surface of the toner image. As a result, separation from the fixing member is smoothly performed, and an image having uniform in-plane gloss free from reduction in gloss and gloss unevenness may be obtained without the disturbance of the smoothness of the image surface at the time of separation. In addition, it is expected that the occurrence of offset or winding can be effectively prevented by the high releasability from the recording member.

Further description is given of the reason why an image having high gloss can be obtained according to the fixing method of the present invention.

In general, a fixed image reflects the surface property of a fixing member as it is. Therefore, when a smooth fixing member is used, the image is affected by the fixing member to have high gloss. However, when the releasability of a toner image in a molten state is not sufficient and separation between a recording medium and a fixing member is not performed satisfactorily, the surface of the fixed image is disturbed at the time of separation, thereby resulting in reduced gloss.

In an image forming method involving fixation by means of only one fixing unit, separation between a recording medium and a fixing member is performed before a release agent sufficiently exudes to the toner surface in fixation. Accordingly, the surface of the fixed image is apt to be disturbed, so it has been difficult to obtain high gloss. In view of the above, in the present invention, fixation is performed in 2 stages. In fixation at the first stage, a release agent is allowed to exude to the toner particle surface to some extent. In fixation at the second stage, additional heat is applied to allow the release agent to sufficiently exude to the toner particle surface, to thereby sufficiently increase the releasability of the toner image in a molten state. A recording medium and a fixing member are separated from each other in this state, whereby an image having high gloss can be obtained without the disturbance of the surface of the fixed image formed smoothly.

When the maximum temperature T1 on a recording medium before and after the recording medium passes through a first fixing unit is equal to or lower than a toner flow starting temperature Tfb, an image density may reduce owing to a rubbing test of the fixed image. This is probably because the fluidity of the toner in a molten state at the time when the recording medium passes through the first fixing unit is insufficient and adhesive force to the recording medium weakens. When the toner is heated to a temperature higher than Tfb at the time when the recording medium passes through the first fixing unit, fixation of the toner to the recording medium is surely performed, so a stable image can be obtained.

When the maximum temperature T2 on the recording medium when the recording medium passes through a second fixing unit is equal to or lower than a minimum temperature t on the recording medium during a time period commencing on ejection of the recording medium from the first fixing unit and ending on entry of the recording medium into the second fixing unit, a heat quantity applied when the recording medium passes through the second fixing unit is small, so it becomes difficult to control gloss. In an image having a large difference in toner mounting amount, gloss unevenness is remarkable, and fixation strength is poor. When the maximum temperature T2 on the recording medium when the recording medium passes through the second fixing unit is higher than the minimum temperature t on the recording medium during a time period commencing on ejection of the recording medium from the first fixing unit and ending on entry of the recording medium into the second fixing unit, a recording material temperature once reduced after the recording medium has passed through the first fixing unit is heated again to a temperature higher than Ts when the recording medium passes through the second fixing unit. As a result, the smoothness of the toner surface on the image surface is aligned, and high gloss may be obtained at a relatively high recording medium conveying speed.

When the minimum temperature t on the recording medium during a time period commencing on ejection of the recording medium from the first fixing unit and ending on entry of the recording medium into the second fixing unit is equal to or lower than the softening temperature Ts of the toner, it becomes difficult to obtain desired gloss. The reason for this is probably as follows. When the recording medium passes through the first fixing unit, the release agent has already exuded to the toner surface from inside a toner particle. Therefore, the release agent content in the toner particle on the recording material after the recording medium has passed through the first fixing unit reduces. As a result, the plastic effect of the binder resin which is provided by the release agent reduces. Therefore, when the minimum temperature t on the recording medium during a time period commencing on ejection of the recording medium from the first fixing unit and ending on entry of the recording medium into the second fixing unit is equal to or lower than the softening temperature Ts of the toner, it becomes difficult to perform sufficient dissolution even when the recording medium passes through the second fixing unit, so high gloss may be hardly obtained. In addition, when the minimum temperature t is equal to or lower than the softening temperature Ts of the toner, the recording medium does not smoothly enter the second fixing unit, with the result that failure in conveyance of the recording medium such as paper jam occurs in some cases. This means that a reduction in temperature after the recording medium has passed through the first fixing unit is large, and is probably because, when the minimum temperature is lower than the softening temperature, heat contraction of the toner becomes large, and curl of the recording medium is apt to occur.

When the flow tester ½ method melting temperature of the toner is denoted by $T_{1/2}$ and the maximum temperature T2 on the recording medium when the recording medium passes through the second fixing unit satisfies the relationship of $T2>T_{1/2}$, the fixing method of the present invention provides an image which has high gloss, has suppressed gloss unevenness, has high color-mixing ability, and is excellent in color reproducibility. When T2 is equal to or lower than $T_{1/2}$ and exceeds t, gloss uniformity is high. However, because T2 is equal to or lower than $T_{1/2}$, the fluidity in a molten state is insufficient, color mixture of toner secondary colors is somewhat insufficient, and color reproducibility is somewhat poor. The foregoing holds true for the case where T2 is equal to or lower than $T_{1/2}$ and is equal to or lower than t.

In the present invention, the first fixing unit is preferably a belt nip fixing type fixing unit. The belt nip fixing type fixing unit can have a wide nip width and a reduced contact pressure. Therefore, a toner image in an unfixed state is hardly disturbed, and can be fixed as it is, whereby a high-quality image is easily obtained. A linear pressured determined by dividing the total load (kgf) between a heating body and a pressurizing body by the width (nip width) of a total pressure-contact portion between the heating body and the pressurizing body is preferably 10 kgf/mm or less.

As described above, the present invention can cope with a high recording medium conveying speed. Therefore, the present invention is particularly preferably applicable to an image forming apparatus having a process speed of 300 mm/sec or more.

In addition, according to the fixing method of the present invention, good fixation can be performed even when a fixing unit having no mechanism for applying oil for preventing offset is used. As a result, an image having high quality and high gloss can be obtained.

Furthermore, the fixing method of the present invention exerts a particularly remarkable effect when applied to a full-color image forming method involving the formation of a full-color image for which uniform gloss is strongly demanded.

In addition, in the fixing method of the present invention, the peak temperature of the maximum endothermic peak in an endothermic curve in differential scanning calorimetry is in the range of preferably 60 to 140° C., or more preferably 70 to 120° C. Such a peak temperature of the maximum endothermic peak can be achieved by incorporating a release agent into toner. When the peak temperature of the maximum endothermic peak is lower than 60° C., the release agent is apt to exude to the toner surface when left in a high temperature environment and the blocking resistance of the toner may deteriorate. In addition, toner spent to a developing sleeve or to a carrier is apt to occur when high-speed development is performed. On the other hand, when the peak temperature of the maximum endothermic peak exceeds 140° C., the release agent cannot quickly move to the molten toner surface upon the fixation and melting of the toner, thereby resulting in poor releasability. As a result, hot offset is apt to occur, and fixability reduces. In addition, low-temperature fixation cannot be performed, and the fixing method may be unable to adapt to high-speed development. To set the maximum endothermic peak temperature of toner to be in the range of 60 to 140° C., it is sufficient to incorporate a release agent having the maximum endothermic peak in the range of 60 to 140° C. into the toner.

Examples of the release agent include: aliphatic hydrocarbon-based waxes such as low-molecular-weight polyethylene, low-molecular-weight polypropylene, a low-molecular-weight olefin copolymer, a microcrystalline wax, a paraffin wax, and a Fischer-Tropsch wax; oxides of aliphatic hydrocarbon-based waxes such as a polyethylene oxide wax; waxes mainly composed of fatty acid esters such as an aliphatic hydrocarbon-based ester wax; and waxes obtained by deoxidizing the whole or part of fatty acid esters such as a deoxidized carnauba wax. The examples further include: partially esterified products of fatty acids and polyhydric alcohols such as behenic acid monoglyceride; and methyl ester compounds having hydroxyl groups obtained through hydrogenation of vegetable fats and oils. A release agent particularly preferably used is an aliphatic hydrocarbon-based wax which has a short molecular chain, has little steric hindrance, and is excellent in mobility such as a paraffin wax. Any one of those release agents is added in an amount of preferably 1.0 to 10.0 parts by mass, or more preferably 3.0 to 7.0 parts by mass with respect to 100 parts by mass of the binder resin.

The maximum temperature T1 on a recording medium when the recording medium passes through a first fixing unit is preferably 160° C. or lower, more preferably 110 to 160° C., or still more preferably 130 to 145° C. When T1 exceeds 160° C., curl of the recording medium is apt to occur, and the recording medium does not smoothly enter second fixation, so a failure in conveyance of the recording medium such as paper jam may occur.

The maximum temperature T2 on the recording medium when the recording medium passes through the second fixing unit is preferably 190° C. or lower, more preferably 140 to 190° C., or still more preferably 150 to 170° C. In this case, in the range of the present invention, an image which causes neither offset nor winding, and has high gloss uniformity can be obtained. When T2 exceeds 190° C., separability between the recording medium and a fixing member deteriorates, and winding to the fixing member may occur.

A difference (ΔT) between the maximum temperature T2 on the recording medium before and after the recording medium passes through the second fixing unit and the minimum temperature t on the recording medium during a time period commencing on ejection of the recording medium from the first fixing unit and ending on entry of the recording medium into the second fixing unit is preferably 10 to 60° C., or more preferably 30 to 60° C. in order to increase the uniformity of the in-plane gloss on the recording medium. When ΔT is lower than 10° C., an image having insufficient gloss may be obtained. On the other hand, when ΔT exceeds 60° C., high gloss is obtained, but offset or winding is apt to occur.

Next, the toner to be used in the present invention will be described in detail.

The toner of the present invention contains at least a binder resin and a colorant. Any one of various resins can be used as the binder resin of the toner according to the present invention. Specific examples of an available resin include a polyester-based resin, a styrene-based resin, an acrylic resin, a styrene-acrylic copolymer resin, and an epoxy-based resin. A resin containing at least a polyester unit is preferably used as the binder resin.

The binder resin preferably used in the present invention is a resin selected from: (a) a polyester resin; (b) a hybrid resin having a polyester unit and a vinyl-based polymer unit; (c) a mixture of a hybrid resin and a vinyl-based polymer; (d) a mixture of a polyester resin and a vinyl-based polymer; (e) a mixture of a hybrid resin and a polyester resin; and (f) a mixture of a polyester resin, a hybrid resin, and a vinyl-based polymer.

In the present invention, the term "polyester unit" refers to a part derived from polyester, and the term "vinyl-based polymer unit" refers to a part derived from a vinyl-based polymer. A unit derived from a monomer having a polyvalent carboxylic acid component and a vinyl group in the monomer, or from a monomer having a polyhydric alcohol component and a vinyl group is defined as a "polyester unit" component.

When a hybrid resin having a polyester unit and a vinyl-based polymer unit is used as the binder resin, additional increases in release agent dispersibility, low-temperature fixability, and offset resistance can be expected. The "hybrid resin" to be used in the present invention means a resin having a vinyl-based polymer unit and a polyester unit chemically bound to each other. For example, an ester exchange reaction between a polyester unit and a vinyl-based polymer unit obtained by polymerizing a monomer having a carboxylate group such as (meth)acrylate results in the formation of a hybrid resin. Preferably, a graft copolymer (or a block copolymer) is formed by using a vinyl-based polymer as a backbone polymer and a polyester unit as a branch polymer.

The binder resin to be used in the toner of the present invention has a main peak in the molecular weight range of 3,500 to 35,000, or preferably 5,000 to 20,000 in a molecular weight distribution measured by means of gel permeation chromatography (GPC) of a resin component, and preferably has a ratio Mw/Mn of 5.0 or more.

When the main peak is less than 3,500, the toner has insufficient hot offset resistance. On the other hand, when the main peak exceeds a molecular weight of 35,000, sufficient low-temperature fixability cannot be obtained, and application to a high-speed machine becomes difficult. In addition, when the ratio Mw/Mn is less than 5.0, sharp melt is achieved and high gloss is easily obtained, but hot offset resistance cannot be obtained.

When a polyester resin is used as a binder resin, an alcohol and one of a carboxylic acid, a carboxylic anhydride, a carboxylate, and the like can be used as raw material monomers. The same holds true for a monomer forming a polyester unit in a hybrid resin. Specific examples of a dihydric alcohol component include: bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane-, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol; diethylene glycol; triethylene glycol; 1,2-propylene glycol; 1,3-propylene glycol; 1,4-butanediol; neopentyl glycol; 1,4-butenediol; 1,5-pentanediol; 1,6-hexanediol; 1,4-cyclohexanedimethanol; dipropylene glycol; polyethylene glycol; polypropylene glycol; polytetramethylene glycol; bisphenol A; and hydrogenated bisphenol A.

Examples of a trihydric or higher alcohol component include sorbitol, 1,2,3,6-hexanetetroler, 1,4-sorbitan, pentaerythritol, dipentaerythritol, tripentaerythritol, 1,2,4-butanetriol, 1,2,5-pentanetriol, glyceroler, 2-methylpropanetriol, 2-methyl-1,2,4-butanetriol, trimethylolerethane, trimethylolerpropane, and 1,3,5-trihydroxymethylbenzene.

Examples of an acid component include: aromatic dicarboxylic acids such as phthalic acid, isophthalic acid, and terephthalic acid, or anhydrides thereof; alkyldicarboxylic acids such as succinic acid, adipic acid, sebacic acid, and azelaic acid, or anhydrides thereof; succinic acid substituted with an alkyl group having 6 to 12 carbon atoms, or anhydrides thereof; and unsaturated dicarboxylic acids such as fumaric acid, maleic acid, and citraconic acid, or anhydrides thereof.

It is particularly preferable that, of those, a bisphenol derivative represented in the following general formula (1) be used as a diol component, and a carboxylic acid component (such as fumaric acid, maleic acid, maleic anhydride, phthalic acid, terephthalic acid, trimellitic acid, or pyromellitic acid) composed of a divalent or higher carboxylic acid, an anhydride thereof, or a lower alkylester thereof be used as an acid component. A polyester resin obtained by polycondensation of those components has excellent charging property as color toner.

[Compound 1]

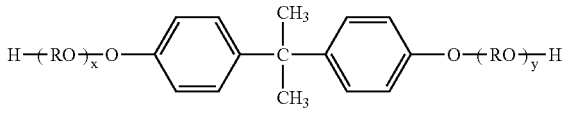

[In the formula, R represents an ethylene or propylene group, x and y each represents an integer of one or more, and x+y has an average value of 2 to 10.]

Examples of a trivalent or higher carboxylic acid component for forming a non-linear polyester resin include 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides and ester compounds thereof. The amount of the trivalent or higher carboxylic acid component to be used is preferably 0.1 to 1.9 mol % on the basis of a total of monomers.

Examples of a vinyl-based monomer for forming a vinyl-based polymer and a vinyl-based polymer unit in a hybrid resin include: styrene; styrenes such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene, and derivatives thereof; styrene unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylic acid or methacrylic acid derivatives such as acrylonitrile, methacrylonitrile, and acrylamide.

The examples further include monomers each having a carboxyl group such as: unsaturated dibasic acids such as maleic acid, citraconic acid, itaconic acid, alkenylsuccinic acid, fumaric acid, and mesaconic acid; unsaturated dibasic anhydrides such as maleic anhydride, citraconic anhydride, itaconic anhydride, and alkenylsuccinic anhydrides; half esters of unsaturated dibasic acids such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dibasic esters such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride; anhydrides of the α,β-unsaturated acids with lower fatty acids; and alkenylmalonic acid, alkenylglutaric acid, alkenyladipic acid, acid anhydrides thereof, and monoesters thereof.

The examples still further include monomers each having a hydroxy group such as: acrylates or methacrylates such as 2-hydroxyethyl acrylate, 2-hydroxyethyl methacrylate, and 2-hydroxypropyl methacrylate; and 4-(1-hydroxy-1-methylbutyl)styrene and 4-(1-hydroxy-1-methylhexyl)styrene.

In the toner of the present invention, each of a vinyl-based polymer and a vinyl-based polymer unit in a hybrid resin may be crosslinked with a crosslinking agent having 2 or more vinyl groups to have a crosslinking structure. Examples of a crosslinking agent used in such a case include: aromatic divinyl compounds such as divinylbenzene and divinylnaphthalene; diacrylate compounds linked with an alkyl chain such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and the above compounds whose acrylate moiety has been replaced with methacrylate; diacrylate compounds linked with an alkyl chain containing an ether linkage such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate, and the above compounds whose acrylate moiety has been replaced with methacrylate; diacrylate compounds linked with a chain containing an aromatic group and an ether linkage such as polyoxyethylene(2)-2,2-bis(4-hydroxyphenyl)propane diacrylate and polyoxyethylene(4)-2,2-bis(4-hydroxyphenyl)propane diacrylate, and the above compounds whose acrylate moiety has been replaced with methacrylate.

Examples of a polyfunctional crosslinking agent include: pentaerythritol triacrylate, trimethylolethane triacrylate, trimethylolpropane triacrylate, tetramethylolmethane tetraacrylate, and oligoester acrylate, and the above compounds whose acrylate moiety has been replaced with methacrylate; triallylcyanurate; and triallyltrimellitate.

Examples of a polymerization initiator to be used in producing the vinyl-based polymer of the present invention include: ketone peroxides such as 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methyl-propane), methyl ethyl ketone peroxide, acetylacetone peroxide, and cyclohexanone peroxide; 2,2-bis(t-butylperoxy)butane; t-butyl hydroperoxide; cumene hydroperoxide; 1,1,3,3-tetramethylbutyl hydroperoxide; di-t-butyl peroxide; t-butylcumyl peroxide; dicumyl peroxide; α,α'-bis(t-butylperoxyisopropyl)benzene; isobutyl peroxide; octanoyl peroxide; decanoyl peroxide; lauroyl peroxide; 3,5,5-trimethylhexanoyl peroxide; benzoyl peroxide; m-trioyl peroxide; di-isopropyl peroxydicarbonate; di-2-ethylhexyl peroxydicarbonate; di-n-propyl peroxydicarbonate; di-2-ethoxyethyl peroxycarbonate; di-methoxyisopropyl peroxydicarbonate; di(3-methyl-3-methoxybutyl) peroxycarbonate; acetylcyclohexylsulfonyl peroxide; t-butyl peroxyacetate; t-butyl peroxyisobutyrate; t-butyl peroxyneodecanoate; t-butyl peroxy- 2-ethylhexanoate; t-butyl peroxylaurate; t-butyl peroxybenzoate; t-butyl peroxyisopropylcarbonate; di-t-butyl peroxyisophthalate; t-butyl peroxyallylcarbonate; t-amyl peroxy-2-ethylhexanoate; di-t-butyl peroxyhexahydroterephthalate, and di-t-butyl peroxyazelate.

The hybrid resin is preferably obtained by subjecting one or both of the vinyl-based polymer and the polyester resin described above to a polymerization reaction in the presence of a polymer containing a monomer unit capable of reacting with each of the vinyl-based polymer and the polyester resin.

Of the monomers constituting the polyester resin component, examples of a monomer capable of reacting with the vinyl-based polymer include unsaturated dicarboxylic acids such as phthalic acid, maleic acid, citraconic acid, and itaconic acid, and anhydrides thereof. Of the monomers constituting the vinyl-based polymer component, examples of a monomer capable of reacting with the polyester resin component include monomers each having a carboxyl group or a hydroxy group, and acrylates and methacrylates.

Examples of a method of producing a hybrid resin include the production methods shown in the following (1) to (5).

(1) A method of producing a hybrid resin, involving: separately producing a vinyl-based polymer and a polyester resin; dissolving and swelling the vinyl-based polymer and the polyester resin in a small amount of organic solvent; adding an esterification catalyst and alcohol to the solution; and heating the mixture to carry out an ester exchange reaction.

(2) A method of producing a hybrid resin, involving: producing a vinyl-based polymer unit; and producing a polyester unit and the hybrid resin in the presence of the vinyl-based polymer unit. The hybrid resin is produced through a reaction between the vinyl-based polymer unit (a vinyl-based monomer may be added as requited) and the polyester monomer (such as alcohol or a carboxylic acid) and/or polyester. An organic solvent may be appropriately used in this case as well.

(3) A method of producing a hybrid resin, involving: producing a polyester unit; and producing a vinyl-based polymer unit and the hybrid resin in the presence of the polyester unit. The hybrid resin is produced through a reaction between the polyester unit (a polyester monomer may be added as required) and the vinyl-based monomer and/or a vinyl-based polymer unit.

(4) A method of producing a hybrid resin, involving: producing a vinyl-based polymer unit and a polyester unit; and adding a vinyl-based monomer and/or a polyester monomer (such as alcohol or a carboxylic acid) in the presence of these polymer units to produce the hybrid resin. An organic solvent may be appropriately used in this case as well.

(5) A method of producing a hybrid resin, involving: mixing a vinyl-based monomer and a polyester monomer (such as alcohol or a carboxylic acid); and continuously subjecting the mixture to addition polymerization and a condensation polymerization reaction to produce a vinyl-based polymer unit, a polyester unit, and the hybrid resin. In addition, an organic solvent may be appropriately used.

In each of the production methods described in the above items (1) to (5), multiple polymer units different from each other in molecular weight and in degree of crosslinking can be used for the vinyl-based polymer unit and/or the polyester unit.

In the present invention, any one of various additives may be incorporated into the toner as required. Examples of such additives include a colorant, a charge control agent, a release agent, and a fluidity improver.

Known pigments and dyes may be used alone or in combination as the colorant of the toner to be used in the present invention. Examples of the dyes include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

Examples of the pigments include Mineral Fast Yellow, Navel Yellow, Naphthol Yellow S, Hansa Yellow G, Permanent Yellow NCG, Tartrazine Lake, Molybdenum Orange, Permanent Orange GTR, Pyrazolone Orange, Benzidine Orange G, Permanent Red 4R, Watching Red calcium salt, eosine lake, Brilliant Carmine 3B, Manganese Violet, Fast Violet B, Methyl Violet Lake, Cobalt Blue, Alkali Blue Lake, Victoria Blue Lake, Phthalocyanine Blue, Fast Sky Blue, Indanthrene Blue BC, Chrome Green, Pigment Green B, Malachite Green Lake, and Final Yellow Green G.

In addition, in the case where each pigment is used as toner for full-color image formation, examples of a magenta coloring pigment include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, and 238; C.I. Pigment Violet 19; and C.I. Vat Red 1, 2, 10, 13, 15, 23, 29, and 35.

Although each of the pigments may be used alone, it is preferable to use in combination a dye and a pigment. Examples of a magenta dye include: oil-soluble dyes such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28.

Examples of a cyan coloring pigment include: C.I. Pigment Blue 2, 3, 15, 15:1, 15:2, 15:3, 16, and 17; C.I. Acid Blue 6; C.I. Acid Blue 45; and copper phthalocyanine pigments each having a phthalocyanine skeleton substituted by 1 to 5 phthalimidomethyl groups.

Examples of a yellow coloring pigment include: C.I. Pigment Yellow 1, 2, 3, 4, 5, 6, 7, 10, 11, 12, 13, 14, 15, 16, 17, 23, 65, 73, 74, 83, 93, 97, 155, 180, and 185; and C.I. Vat Yellow 1, 3, and 20.

Examples of a black pigment include carbon black such as furnace black, channel black, acetylene black, thermal black, and lamp black. Magnetic powder such as magnetite or ferrite may also be used. One having a black tone obtained by using the yellow/magenta/cyan/black colorants described above.

The amount of the colorant to be used is preferably 1 to 15 parts by mass, more preferably 3 to 12 parts by mass, or still more preferably 4 to 10 parts by mass with respect to 100 parts by mass of the binder resin. When the colorant content is larger than 15 parts by mass, transparency reduces. In addition, the reproducibility of a halftone typified by a human skin color is apt to reduce. Furthermore, the stability of chargeability of toner reduces, and low-temperature fixability is hardly obtained. When the colorant content is smaller than 1 part by mass, coloring power reduces, so an increased amount of toner must be used to achieve a high density, and low-temperature fixability may be poor. When magnetic powder is used as the colorant, the amount of the magnetic powder is preferably 50 to 150 parts by mass with respect to 100 parts by mass of the binder resin.

The toner that can be used in the present invention may contain a known charge control agent. Examples of such a charge control agent include organometallic complexes, metal salts, and chelate compounds such as monoazo metal complexes, acetylacetone metal complexes, hydroxycarboxylic acid metal complexes, polycarboxylic acid metal complexes, and polyol metal complexes. In addition to the above compounds, the examples include: carboxylic acid derivatives such as carboxylic acid metal salts, carboxylic anhydrides, and carboxylates; and condensates of aromatic compounds. Any one of phenol derivatives such as bisphenols and calixarenes may also be used as the charge control agent. In the present invention, each of aromatic carboxylic acid metal compounds is preferably used to render rising of charge satisfactory.

A charge control agent content is preferably 0.1 to 10 parts by mass, or more preferably 0.2 to 5 parts by mass with respect to 100 parts by mass of the binder resin. A charge control agent content of less than 0.1 part by mass may enlarge variations in charge amount of the toner in environments including a high-temperature-and-high-humidity environment and a low-temperature-and-low-humidity environment. A charge control agent content of more than 10 parts by mass may result in poor low-temperature fixability of the toner.

The kinds of release agents that can be added to the toner are as described above. The amount of the release agent to be added is preferably 1 to 10 parts by mass, or more preferably 2 to 8 parts by mass with respect to 100 parts by mass of the binder resin. If the content is less than 1 part by mass, releasability may not be exerted well upon oilless fixing, or low-temperature fixability may not be satisfied. If the content exceeds 10 parts by mass, the release agent is apt to exude to the toner surface, so developability deteriorates or spent resistance deteriorates in some cases. The wax to be used in the present invention has a number average molecular weight (Mn) in the range of preferably 200 to 2,000, or more preferably 350 to 1,000, and a weight average molecular weight (Mw) in the range of preferably 200 to 2,500, or more preferably 350 to 1,200 in a molecular weight distribution by GPC measurement. When the wax has the molecular weight distribution within the above range, the toner can be provided with preferable heat characteristics. That is, when Mn or Mw is smaller than the above range, the toner becomes excessively susceptible to heat, so the toner is poor in blocking resistance and developability. When Mn or Mw is larger than the above range, external heat cannot be effectively utilized, so excellent fixability and excellent offset resistance are hardly obtained. When Mw/Mn exceeds 2, melting behavior is not sharp with respect to heat owing to a wide molecular weight distribution, so a range in which both good fixability and good offset resistance are satisfied is hardly obtained.

The toner to be used in the present invention may be added with a conventionally known external additive as a superplasticizer for controlling fluidity or developability. Examples of an available external additive include: various inorganic oxide fine particles of silica, alumina, titanium oxide, cerium oxide, and the like; fine particles subjected to a hydrophobic treatment as required; vinyl-based polymers; zinc stearate; and resin fine particles. The amount of the external additive to be added is in the range of preferably 0.02 to 5 mass % with respect to toner particles.

Furthermore, titanium oxide is preferably added from the viewpoints of increasing charging property, fluidity, and transferability. Furthermore, silica and titanium oxide are preferably used in combination.

When titanium oxide is used, the fluidity of toner can be increased without any damage to the charging property of the toner. On the other hand, when only silica is added, the negative property of silica is strong, so surface charge-up is apt to occur as compared to the case where titanium oxide and silica are used in combination.

The primary particle size of an external additive to be used in the present invention is preferably 10 to 200 nm. In this case, an excellent fluidity imparting effect and a preventing effect on deterioration of charging ability resulting from adhesion of toner to a carrier at the time of duration can be obtained. In addition, a specific surface area according to a BET method is preferably 20 to 500 $m^2/g$.

Next, a method of producing toner that can be used in the present invention will be described. A toner production method that can be used in the present invention is not particularly limited, and any one of various conventionally known production methods can be used.

A production method according to melt kneading pulverization is preferable as the toner production method from the viewpoints of a wide selection of materials and easy control of flow tester physical properties. To be specific, a preferable method involves: melting and kneading a binder resin, a colorant, and an arbitrary material; cooling the resultant kneaded product; pulverizing the kneaded product; subjecting the pulverized product to a spheroidizing treatment and a classification treatment as required to prepare toner particles; and mixing the particles with the superplasticizer as required to produce toner.

First, in a raw material mixing step, predetermined amounts of at least a resin and a colorant as toner internal additives are weighed and mixed. Examples of a mixer include a double cone mixer, a V-type mixer, a drum type mixer, a super mixer, a Henschel mixer, and a Nauta mixer.

Furthermore, the toner raw materials blended and mixed in the above step are melted and kneaded to melt resins, and the colorant and the like are dissolved into the molten resins. In the melting and kneading step, a batch type kneader such as a pressure kneader or a Banbury mixer, or a continuous kneader can be used. In recent years, a uniaxial or biaxial extruder has gone mainstream because of its superiority such as the ability of continuous production. Examples of a uniaxial or biaxial extruder generally used include a KTK type biaxial extruder manufactured by Kobe Steel, Ltd., a TEM type biaxial extruder manufactured by Toshiba Machine Co., Ltd, a biaxial extruder manufactured by KCK, and a Ko-kneader manufactured by Bus. A colored resin composition obtained by melting and kneading the toner raw materials is rolled by means of a two-roll mill or the like after the melting and kneading, and is cooled through a cooling step of cooling the composition with water or the like.

In general, the cooled product of the colored resin composition obtained in the above step is subsequently pulverized to a desired particle size in a pulverizing step. In the pulverizing step, the cooled product is coarsely pulverized by means of a crusher, a hammer mill, a feather mill, or the like, and the coarsely pulverized product is additionally pulverized by means of a Kryptron system manufactured by Kawasaki Heavy Industries, Ltd., a Super Rotor manufactured by Nisshin Engineering, Inc, or the like. After that, the resultant is classified as required by means of a screen classifier such as an Elbow Jet of an inertial classification type (manufactured by Nittetsu Mining Co., Ltd.) or a Turboplex of a centrifugal classification type (manufactured by Hosokawa Micron Ltd.).

In addition, in the present invention, classification and a surface modification treatment can be performed at the same time. Toner particles are preferably treated by means of a surface modification apparatus shown in FIG. 7.

Figure 7:
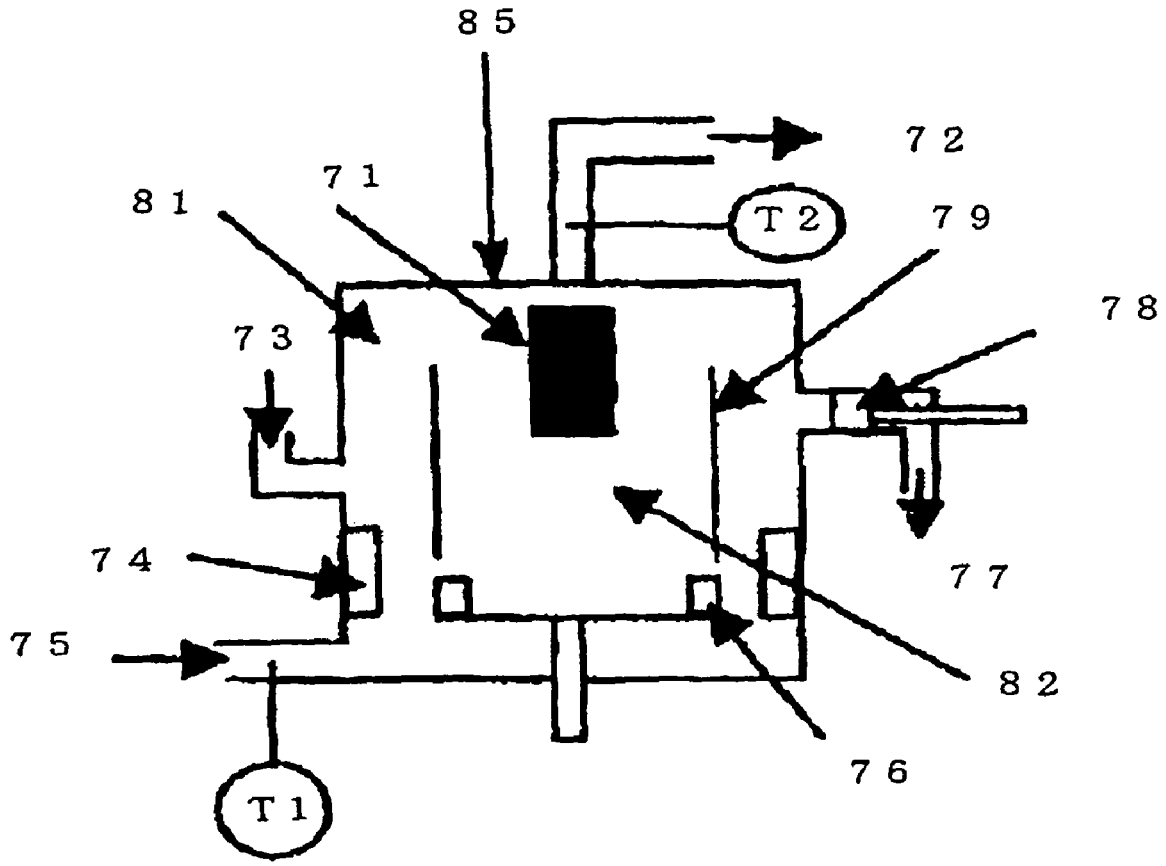
FIG. 7 is a schematic view showing an example of a surface modification apparatus used in the present invention.

The surface modification apparatus shown in FIG. 7 includes: a casing 85; a jacket (not shown) through which cooling water or antifreeze can pass; a classification rotor 71 serving as classification means for classifying fine particles each having a predetermined particle size or less; a dispersion rotor 76 as surface modification means for treating the surfaces of the particles by applying mechanical impact to the particles; a liner 74 arranged around the dispersion rotor 76 with a predetermined interval with respect to the outer periphery of the dispersion rotor 76; a guide ring 79 serving as guide means for guiding the particles each having the predetermined particle size out of the particles classified by the classification rotor 71 to the dispersion rotor 76; a discharge port 72 for collecting fine powder, the discharge port 72 serving as discharge means for discharging fine particles each having the predetermined particle size or less out of the particles classified by the classification rotor 71 to the outside of the apparatus; a cold air introducing port 75 serving as particle circulation means for sending the particles surface-treated by the dispersion rotor 76 to the classification rotor 71; a raw material supply port 73 for introducing the treated particles into the casing 85; and a powder discharge port 77 for discharging the surface-treated particles from the casing 85, the powder discharge port 77 being openable/closable by a discharge valve 78.

The classification rotor 71 is a cylindrical rotor, and is arranged on an upper end portion in the casing 85. The discharge port 72 for collecting fine powder is arranged on one end portion of the casing 85 to discharge the particles in the classification rotor 71. The raw material supply port 73 is arranged at the center of the peripheral surface of the casing 85. The cold air introducing port 75 is arranged on the other end portion of the peripheral surface of the casing 85. The powder discharge port 77 is arranged at a position in the peripheral surface of the casing 85 opposed to the raw material supply port 73. The discharge valve 78 is a valve for freely opening/closing the powder discharge valve 77.

Figure 8:
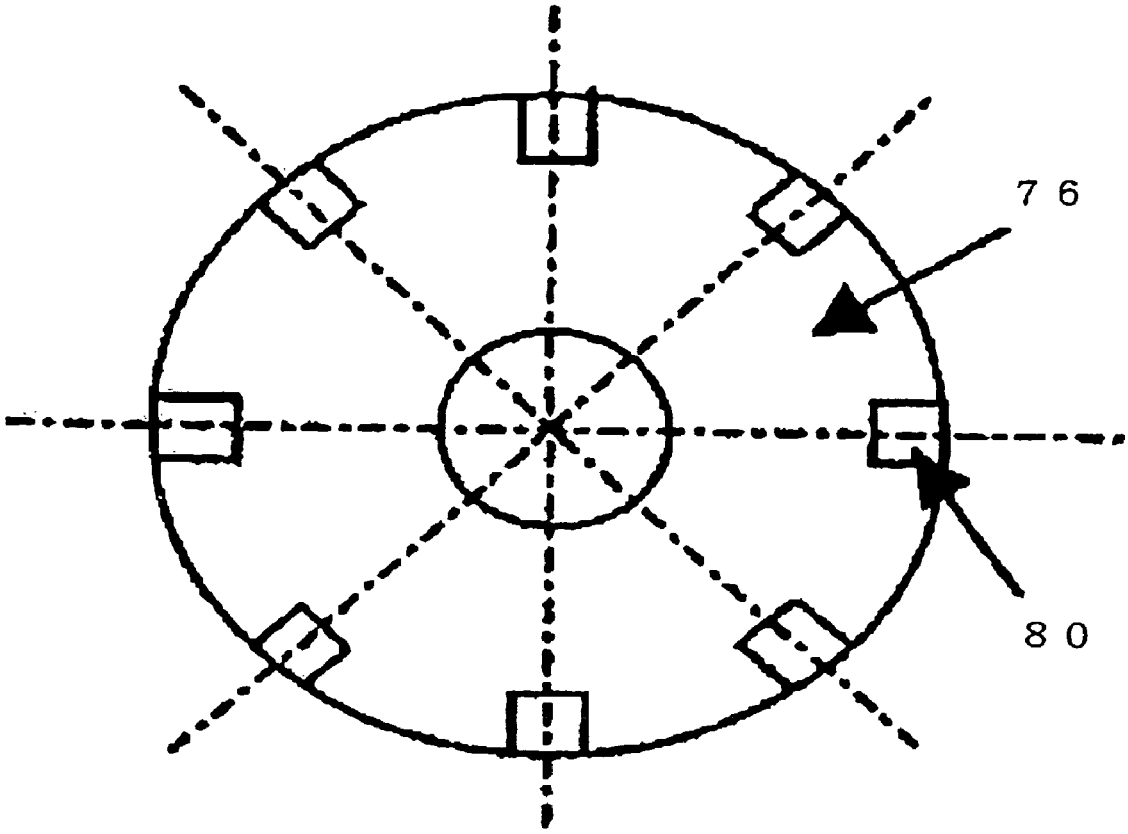
FIG. 8 is a schematic view showing an example of a dispersion rotor in the surface modification apparatus used in the present invention.

The dispersion rotor 76 and the liner 74 are arranged between the cold air introducing port 75 and each of the raw material supply port 73 and the powder discharge port 77. The liner 74 is arranged along the inner peripheral surface of the casing 85. As shown in FIG. 8, the dispersion rotor 76 has a disk and multiple square disks 80 arranged on the circumference of the disk along the normal of the disk. The dispersion rotor 76 is arranged on the underside of the casing 85, is arranged on upper surface, and at a position where a predetermined interval is formed between the liner 74 and each of the square disks 80. The guide ring 79 is arranged at the central portion of the casing 85. The guide ring 79 is a cylindrical body, and is arranged at a position covering part of the outer peripheral surface of the classification rotor 71 to extend to the vicinity of the dispersion rotor 76. The guide ring 79 forms, in the casing 85, a first space 81 sandwiched between the outer peripheral surface of the guide ring 79 and the inner peripheral surface of the casing 85 and a second space 82 as an inner space of the guide ring 79.

The dispersion rotor 76 may have cylindrical pins instead of the multiple square disks 80. The liner 74 is provided with a large number of grooves on its surface opposed to the square disks 80 in this embodiment, but may have no grooves on its surface. The classification rotor 71 may be installed vertically as shown in FIG. 7, or may be installed horizontally. In addition, the number of the classification rotor 71 may be one as shown in FIG. 7, or may be 2 or more.

In addition, as required, the particles may be further subjected to surface modification and a spheroidization treatment by means of a Hybridization System manufactured by Nara Machinery Co., Ltd., or a Mechanofusion System manufactured by Hosokawa Micron Ltd. In such a case, a screen classifier such as a HIBOLTER (manufactured by Shin-Tokyo Kikai), a wind force screen, may be used. Furthermore, an example of a method of externally treating an external additive includes a method involving: blending predetermined amounts of classified toner and conventionally known various external additives with each other; and stirring and mixing the whole by using a high-speed stirring device for applying shear force to powder such as a Henschel mixer or a super mixer as an external addition device.

Examples of other methods of producing toner that can be used in the present invention include: a method of directly producing toner particles by using suspension polymerization; dispersion polymerization involving the use of an aqueous organic solvent into which a monomer is soluble and a polymer to be obtained is insoluble to directly product toner particles; and a method of producing toner particles by using emulsion polymerization typified by soap free polymerization for producing toner particles through direct polymerization in the presence of a water-soluble polar polymerization initiator. Production methods such as interfacial polymerization like a microcapsule production method, in situ polymerization, and coacervation may also be used.

Examples of a polymerization initiator used when producing toner particles by using suspension polymerization include: azo-based polymerization initiators such as 2,2'-azobis(2,4-dimethylvaleronitrile), 2,2'-azobisisobutyronitrile, 1,1'-azobis(cyclohexane-1-carbonitrile, 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

The amount of a polymerization initiator to be added, which varies depending on a target degree of polymerization, is generally 0.5 to 20 mass % with respect to a monomer. The number of kinds of polymerization initiators, which slightly varies depending on a polymerization method, is one or 2 or more with reference to a 10-hour half life temperature. Any one of conventionally known crosslinking agents, chain transfer agents, polymerization inhibitors, and the like for controlling a degree of polymerization may be further added.

An inorganic oxide may be used as a dispersant when suspension polymerization is used as a toner production method. Examples of the inorganic oxide include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of an organic compound include polyvinyl alcohol, gelatin, methylcellulose, methylhydroxypropylcellulose, ethylcellulose, sodium carboxymethylcellulose, and starch. Each of them is dispersed into an aqueous phase before use. Each of those dispersants is preferably used in an amount of 0.2 to 10.0 parts by mass with respect to 100 parts by mass of a polymerizable monomer.

Those dispersants may be those commercially available without any treatment. However, in order to obtain dispersed particles each having a fine and uniform grain size, any one of the inorganic compounds may be produced in a dispersion medium under high-speed stirring. For example, in the case of tricalcium phosphate, a dispersion medium preferable for suspension polymerization can be prepared by mixing an aqueous solution of sodium phosphate and an aqueous solution of calcium chloride under high-speed stirring. 0.001 to 0.1 part by mass of a surfactant may also be used in combination in order to make those dispersants fine. To be specific, commercially available nonionic, anionic, or cationic surfactants may be used. Examples thereof include sodium dodecyl sulfate, sodium tetradecyl sulfate, sodium pentadecyl sulfate, sodium octyl sulfate, sodium oleate, sodium laurate, potassium stearate, and calcium oleate.

In the case where direct polymerization is used for a toner production method, toner can be specifically produced according to the production method described below. A release agent, a colorant, a charge control agent, a polymerization initiator, and other additives each of which is composed of a low-softening-point substance are added to a monomer, and the whole is evenly dissolved or dispersed by means of a homogenizer, an ultrasonic dispersing unit, or the like to prepare a monomer composition. Then, the monomer composition is dispersed into an aqueous phase containing a dispersant by means of an ordinary stirring device, or a homomixer, a homogenizer, or the like. Preferably, liquid droplets composed of the monomer composition are granulated while a stirring speed and a stirring time are adjusted so that the resultant has a desired toner particle size. After that, stirring has only to be performed to the extent that a particle state is maintained by virtue of the action of a dispersant and the sedimentation of particles is prevented. Polymerization is performed at a polymerization temperature set to 40° C. or higher, or generally 50 to 90° C. The temperature may be increased in the latter half of the polymerization reaction. For the purpose of improving durability, part of an aqueous medium may be distilled off in the latter half of the reaction or after the completion of the reaction to remove an unreacted polymerizable monomer and a by-product. After the completion of the reaction, the resultant toner particles are washed, collected through filtrate, and dried. In suspension polymerization, water is typically used as a dispersant in an amount of preferably 300 to 3,000 parts by mass with respect to 100 parts by mass of the polymerizable monomer.

Next, inorganic fine particles and, as required, other external additives are added to the resultant toner particles. A method of performing external addition treatment involves: blending predetermined amounts of classified toner particles and an external additive with each other; stirring and mixing the whole by using a high-speed stirring device for applying shear force to powder such as a Henschel mixer or a super mixer as an external addition device. With the method, the toner of the present invention can be obtained.

In addition, the toner of the present invention has a weight average particle diameter (D4) in the range of preferably 4 to 10 μm, or more preferably 5 to 9 μm.

A weight average particle diameter of the toner in excess of 10 μm means that the number of fine particles capable of contributing to an increase in image quality is small, and provides a merit that a high image density is easily obtained and the toner is excellent in fluidity. However, in such a case, the toner hardly faithfully adheres to a fine electrostatic charge image on a photosensitive drum, so the reproducibility of a highlight portion reduces and the resolution also reduces. In addition, the toner is mounted on the electrostatic charge image in an amount more than necessary, so an increase in toner consumption is apt to occur.

On the other hand, when the weight average particle diameter of the toner is less than 4 μm, the charge amount of the toner per unit mass increases, and a reduction in image density, in particular, a reduction in image density in low temperature and low humidity becomes remarkable. Therefore, a weight average particle diameter of the toner of less than 4 μm is not suitable for applications where an image area ratio is high such as a graphic image.

Furthermore, when the weight average particle size of the toner is less than 4 μm, contact charging with a charge imparting member such as a carrier is hardly performed smoothly. As a result, the amount of toner that cannot be sufficiently charged increases, and fogging due to scattering to a non-image portion becomes remarkable. One possible approach to increase the specific surface area of the carrier for the purpose of coping with such a detrimental effect is to reduce the diameter of the carrier. However, in the toner having a weight average particle size of less than 4 μm, toner agglomeration is apt to occur, and uniform mixing with the carrier is hardly achieved, so fogging tends to occur in continuous image output.

In the present invention, each of a one-component developer composed only of toner (containing no carrier) and a two-component developer composed of toner and a carrier can be used.

When the toner of the present invention is used for a two-component developer, the toner is mixed with a magnetic carrier before use. Examples of an available magnetic carrier include: metal particles of iron, lithium, calcium, magnesium, nickel, copper, zinc, cobalt, manganese, chromium, rare earth elements, and the like, each of which is surface-oxidized or unoxidized, alloy particles, oxide particles, and ferrites thereof. In addition, in a development method involving applying alternating bias to a developing sleeve, a coated carrier obtained by coating the surface of a magnetic carrier core with a resin is preferably used. Any one of conventionally known methods is applicable as a coating method. Examples of the conventionally known methods include: a method involving dissolving or suspending a coating material such as a resin into a solvent to prepare an application solution, and allowing the application solution to adhere to a magnetic carrier core particle surface; and a method involving mixing a magnetic carrier core particle and a coating material in powder form. Examples of a coating material for a magnetic carrier core particle surface include a silicone resin, a polyester resin, a styrene-based resin, an acrylic resin, polyamide, polyvinyl butyral, and an amino acrylate resin. Each of them may be used alone, or 2 or more of them may be used in combination. The amount of the coating material to be used is preferably 0.1 to 30 mass % (or more preferably 0.5 to 20 mass %) with respect to the carrier core particles. When the toner of the present invention and a magnetic carrier are mixed to prepare a two-component developer, a mixing ratio between them that provides good results is such that the toner concentration in the developer is generally 2 to 15 mass %, or preferably 4 to 13 mass %. A toner concentration of less than 2 mass % is apt to cause a reduction in image density, while a toner concentration in excess of 15 mass % is apt to cause fogging or scattering in an apparatus.

A magnetic ferrite particle mainly formed of 3 elements, that is, manganese (Mn), magnesium (Mg), and iron (Fe), is preferable as a carrier. Such a magnetic carrier is preferably coated with a resin, and the resin is preferably a silicone resin. In particular, a nitrogen-containing silicone resin or a denatured silicone resin produced through a reaction between a nitrogen-containing silane coupling agent and a silicone resin is preferable in terms of impartment of negative frictional charge to the toner of the present invention, environmental stability, and suppression of contamination to the carrier surface.

The magnetic carrier has a number average particle diameter (D1) in the range of preferably 15 to 60 μm (or more preferably 25 to 50 μm) from the viewpoint of the relationship with the weight average particle size of the toner. Magnetic particles constituting the magnetic carrier and having the above number average particle size can be prepared through, for example, classification by means of a screen. In particular, in order to perform classification with high accuracy, it is preferable to sift a screen having an appropriate aperture multiple times. A screen with the shape of an opening controlled by plating or the like is also effective means.

Hereinafter, methods of analyzing and measuring physical properties according to the present invention will be described.

<Methods of Measuring Softening Point, Flow Starting Temperature, and ½ Method Melting Temperature of Toner>

Figure 5:
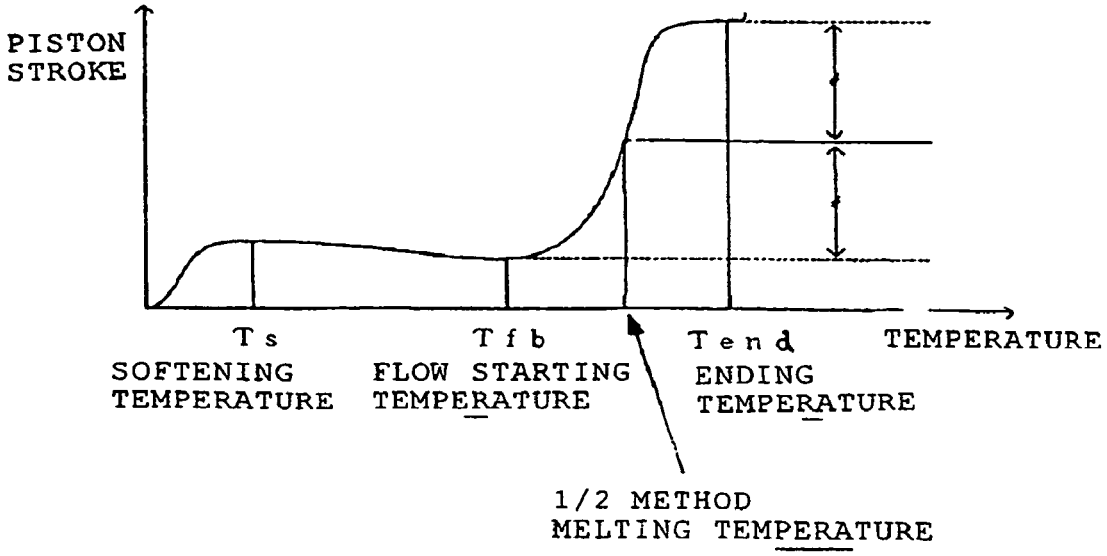
FIG. 5 is a schematic view showing a flow curve in a flow tester temperature increase method of the present invention, and a softening temperature, a flow starting temperature, and a ½ method melting temperature defined in the present invention.

These temperatures refer to those measured by means of a constant-load extrusion capillary rheometer, that is so-called a flow tester. A specific measurement method is shown below. A sample of 1 $cm^3$ is kept at 50° C. for 5 minutes in a flow tester CFT-500D (Shimadzu Corporation). After that, the sample is extruded from a die pore of 0.5 mm under a load of 10 $kg/cm^2$ for measurement while the temperature is increased at a rate of 4° C./min. FIG. 5 schematically shows a flow curve obtained by measuring the toner in the flow tester, in which the axis of abscissa indicates a temperature and the axis of ordinate indicates a piston stroke. Shown in the figure are the softening temperature Ts, the flow starting temperature Tfb, and the ½ method melting temperature $T_{1/2}$ as a midpoint between the flow starting temperature and a flow ending temperature defined in the present invention.

<Measurement of Maximum Endothermic Peaks of Toner and Wax by DSC>

Maximum endothermic peaks of a toner and a wax can be measured in compliance with ASTM D 3418-82 by using a differential thermal analyzer (DSC measuring device) DSC 2920 (manufactured by TA Instruments Japan).

Temperature curve:

Temperature increase I (30° C. to 200° C., at a rate of temperature increase of 10° C./min)

Temperature decrease I (200° C. to 30° C., at a rate of temperature decrease of 10° C./min)

Temperature increase II (30° C. to 200° C., at a rate of temperature increase of 10° C./min)

A measurement method is as follows. 5 to 20 mg, preferably 10 mg of a measurement sample are precisely weighted, charged into an aluminum pan, and measurement is performed in the measurement temperature range of 30 to 200° C., at a rate of temperature increase of 10° C./min, and in normal temperature and normal humidity (23° C., 60% RH). Measurement by using an empty pan as a reference is performed in the same manner as above. The maximum endothermic peak of each of the toner and the wax is an endothermic peak with the maximum height measured from a base line in the range above a endothermic peak of resin Tg during Temperature Increase II. When it is difficult to distinguish the endothermic peak because the endothermic peak of resin Tg overlaps other endothermic peaks, the highest one out of the overlapping local maximum peaks is defined as the maximum endothermic peak of the present invention.

<Molecular Weight Distribution by GPC Measurement of Binder Resin>

The molecular weight of a chromatogram by means of gel permeation chromatography (GPC) is measured under the following conditions.

A column is stabilized in a heat chamber at 40° C. Tetrahydrofuran (THF) as a solvent is allowed to flow into the column at the temperature at a flow rate of 1 ml/min. About 50 to 200 μl of a THF sample solution of a resin with a sample concentration adjusted to be within the range of 0.05 to 0.6 mass % are injected for measurement. In measuring the molecular weight of a sample, the molecular weight distribution of the sample is calculated from the relationship between a logarithmic value of a calibration curve prepared by several kinds of monodisperse polystyrene standard samples and the number of counts (retention time). Examples of available polystyrene standard samples for preparing a calibration curve include samples manufactured by Tosoh Corporation or Pressure Chemical Co. having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$. At least about 10 polystyrene standard samples are suitably used. An RI (refractive index) detector is used as a detector.

It is recommended that multiple commercially available polystyrene gel columns be combined to be used as the column in order to precisely measure the molecular weight range of $10^3$ to $2\times10^6$. Preferable examples of the combination include: a combination of shodex GPC KF-801, 802, 803, 804, 805, 806, and 807 manufactured by Showa Denko K. K.; and a combination of μ-styragel 500, $10^3$, $10^4$, and $10^5$ manufactured by Waters Corporation.

<Molecular Weight Distribution of Wax>

(GPC Measurement Condition)

Device: GPC-150C (Waters Corporation)

Column: GMH-HT 30 cm double (Tosoh Corporation)

Temperature: 135° C.

Solvent: o-dichlorobenzene (added with 0.1% ionol)

Flow Rate: 1.0 ml/min

Sample: 0.4 ml of a 0.15% sample is injected

Measurement is performed under the above conditions, and a molecular weight calibration curve prepared by monodisperse polystyrene standard samples is used in calculating the molecular weight of the sample. Furthermore, the molecular weight is subjected to polyethylene conversion by using a conversion equation derived from the Mark-Houwink viscosity equation.

<Measurement of Average Circularity of Toner>

The average circularity of the toner is calculated as follows after measurement with a flow-type particle image measuring device "FPIA-2100" (manufactured by Sysmex Corporation).

The circularity in the present invention is an indication of the degree of irregularities on a toner particle, and is defined by the following equations. The circularity is 1.000 when the toner particle has a completely spherical shape. The more complicated the surface shape, the lower the circularity.

Circle-equivalent diameter=(Particle projected area×π)$^{1/2}$×2

Circularity=(Circumferential length of a circle having the same area as the particle projected area)/(Circumferential length of a particle projected image) [Formula 1]

The term "particle projected area" is defined as an area of a binarized toner particle image, while the term "circumferential length of a particle projected image" is defined as the length of a borderline obtained by connecting the edge points of the toner particle image. The measurement is performed by using the circumferential length of a particle image that has been subjected to image processing at an image processing resolution of 512×512 (a pixel measuring 0.3 μm×0.3 μm).

In addition, the average circularity C which means the average value of a circularity frequency distribution is calculated from the following equation when the circularity (central value) of a divisional point i in a particle size distribution is denoted by ci and the number of measured particles is denoted by m.

$$\text{Average circularity } c = \sum_{i=1}^{m} ci/m \quad \text{[Formula 2]}$$

The measuring device "FPIA-2100", which is used in the present invention, calculates the average circularity by: calculating the circularities of the respective particles; classifying the particles into classes, which are obtained by equally dividing the circularity range of 0.40 to 1.00 at an interval of 0.01, depending on the resultant circularities; and calculating the average circularity by using the central value of each divisional point and the number of measured particles.

A specific measurement method is as follows. 10 ml of ion-exchanged water from which an impurity solid and the like have been removed in advance are prepared in a vessel. A surfactant, preferably alkylbenzene sulfonate, is added as a dispersant to the ion-exchanged water, and then 0.02 g of measurement sample is added to and uniformly dispersed into the mixture. The resultant mixture is subjected to a dispersion treatment for 2 minutes by using an ultrasonic dispersing unit "Tetora 150" (manufactured by Nikkaki-Bios Co., Ltd.) as dispersion means to prepare a dispersion for measurement. At that time, the dispersion is appropriately cooled in order that the temperature of the dispersion may not be 40° C. or higher. To suppress a variation in circularity, the temperature of an environment in which the flow-type particle image measuring device FPIA-2100 is placed is controlled at 23° C.±0.5° C. in such a manner that the temperature inside the device is in the range of 26 to 27° C. Automatic focusing is performed by using a 2-μm latex particle at a predetermined time interval, preferably at an interval of 2 hours.

The flow-type particle image measuring device is used for the measurement of the circularity of a toner particle. The concentration of the dispersion is adjusted again in such a manner that the toner particle concentration at the time of measurement is in the range of 3,000 to 10,000 particles/μl, and 1,000 or more toner particles are measured. After the measurement, the average circularity of the particles is determined by using the data with data on particles each having a circle-equivalent diameter of less than 2 μm discarded.

The measuring device "FPIA-2100", which is used in the present invention, has increased the accuracy of toner shape measurement as compared to a measuring device "FPIA-1000", which has been conventionally used to calculate the shape of toner, by increasing the magnification of a processed particle image and by increasing the processing resolution of a captured image (256×256 to 512×512). As a result, the measuring device "FPIA-2100" has achieved more accurate capture of a fine particle. Therefore, in the case where a shape must be measured more accurately as in the present invention, the FPIA-2100, which provides more accurate information on the shape, is more useful than the FPIA-1000.

<Measurement of Particle Size Distribution of Toner>

A Coulter Counter Multisizer II (manufactured by Beckman Coulter, Inc) is used as a measuring device. An about 1% aqueous solution of NaCl is used as an electrolyte. For example, an electrolyte prepared by using extra-pure sodium chloride or ISOTON (registered trademark)-II (manufactured by Coulter Scientific Japan) can be used as the electrolyte.

A measurement method is as follows. 0.1 to 5 ml of a surfactant (preferably an alkyl benzene sulfonate) as a dispersant are added to 100 to 150 ml of the electrolyte. Then, 2 to 20 mg of measurement samples are added to the electrolyte. The electrolyte in which the samples are suspended is subjected to a dispersion treatment in an ultrasonic dispersing unit for about 1 to 3 minutes. After that, by using a 100-μm aperture as an aperture, the volumes and number of samples are measured for each channel by the measuring device to calculate the volume and number distributions of the samples. The weight average particle diameter (D4) of the samples is determined from the resultant distributions. Used as the channels are 13 channels of: 2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32 to 40.30 μm.

<Measurement of Image Gloss by Means of Glossmeter>

In measuring gloss, a reflection light quantity in a 60° direction is measured by means of a VG-10 glossmeter (manufactured by Nippon Denshoku). The gloss of a solid image at each of 5 points (both ends, a center, and a midpoint between each of the ends and the center) is measured, and the average of the 5 measurements is defined as gloss for each image. In the measurement, at first, 6 V is set by means of a voltage stabilizer. Then, each of a projecting angle and a light receiving angle is set to 60°. Standard setting is performed by using zero adjustment and a standard plate. After that, the sample image is placed on a sample table. Furthermore, 3 pieces of white paper are overlapped below the sample image to carry out measurement. A numerical value indicated in an indication portion is read in % units. At this time, an S-S/10 changeover switch is set to S, and an angle-sensitivity changeover switch is set to 45-60.

<Measurement of Image Density>

In the present invention, an image density is measured by using a spectrodensitometer 504 manufactured by X-Rite Co. An image to be measured is arbitrarily measured 5 times. The average of the 5 measurements is defined as the image density.

<Measurement of Number Average Primary Particle Size of Inorganic Fine Particles>

The average primary particle size of inorganic fine particles is measured by: photographing toner particle surfaces at a magnification of 100,000 by using a scanning electron microscope FE-SEM (manufactured by Hitachi, Ltd.); further magnifying the magnified photograph as required; and measuring the primary particle size of each of 50 or more particles by means of a ruler, a caliper, or the like to determine the number average primary particle size. At that time, the composition of a fine particle is judged by detecting only a designated specific element by means of an X-ray microanalyzer of the above apparatus.

<Measurement of BET Specific Surface Area of Inorganic Fine Particle>

According to the BET method, nitrogen gas is adsorbed to the sample surface by using a specific surface area measuring device Autosoap 1 (manufactured by Yuasa Ionics Inc), and a specific surface area is calculated by using the BET multipoint method. At that time, the sample is subjected to evacuation for 5 hours.

EXAMPLES

Hereinafter, the present invention will be described in more detail by way of specific production examples and examples. However, the present invention is not limited to these examples.

Production Example of Resin A

Hybrid Resin

Placed into a dropping funnel were 1.9 mol of styrene, 0.21 mol of 2-ethylhexyl acrylate, 0.15 mol of fumaric acid, 0.03 mol of a diner of α-methylstyrene, and 0.05 mol of dicumyl peroxide as vinyl-based polymers. Placed in a 4-liter four-necked flask made of glass were 7.0 mol of polyoxypropylene (2.2)-2,2-bis(4-hydroxyphenyl)propane, 3.0 mol of polyoxyethylene(2.2)-2,2-bis(4-hydroxyphenyl)propane, 3.0 mol of terephthalic acid, 2.0 mol of trimellitic anhydride, 5.0 mol of fumaric acid, and 0.2 g of dibutyltin oxide as polyester monomers. A thermometer, a stirring bar, a condenser, and a nitrogen introducing pipe were installed on the four-necked flask, and the flask was placed in a mantle heater. Subsequently, air in the flask was substituted by nitrogen gas, and the flask was gradually heated while the mixture in the flask was stirred. Then, the monomers for a vinyl-based resin and a polymerization initiator were dropped from the dropping funnel over 5 hours to the flask while the mixture in the flask was stirred at 145° C. Next, the mixture in the flask was heated to 220° C., and was reacted for 4 hours to yield a hybrid resin. Table 1 shows the molecular weight measurements by gel permeation chromatography (GPC) of the hybrid resin. In Table 1, Mw represents a weight average molecular weight, Mn represents a number average molecular weight, and Mp represents a main peak molecular weight.

Production Example of Resin B

Styrene-Acrylic Resin Production Example

| | |
|---|---|
| Styrene | 70 parts by mass |
| n-butyl acrylate | 25 parts by mass |
| Monobutyl maleate | 5 parts by mass |
| Di-t-butylperoxide | 1 part by mass |

Air in a four-necked flask was sufficiently substituted by nitrogen while 200 parts by mass of xylene were stirred in the four-necked flask. After the flask had been heated to 120° C., the above components were dropped over 3.0 hours to the flask. Furthermore, polymerization was completed under xylene reflux, followed by removal of a solvent by distillation under reduced pressure to yield a styrene-acrylic resin. Table 1 shows the molecular weight measurements by gel permeation chromatography (GPC) of the styrene-acrylic resin.

Production Example of Resin C

Polyester Resin Production Example

Placed in a 4-liter four-necked flask made of glass were 3.6 mol of polyoxypropylene(2.2)-2,2-bis(4-hydroxyphenyl) propane, 1.6 mol of polyoxyethylene(2.2)-2,2-bis(4-hydroxyphenyl)propane, 1.7 mol of terephthalic acid, 1.1 mol of trimellitic anhydride, 2.4 mol of fumaric acid, and 0.1 g of dibutyltin oxide. A thermometer, a stirring bar, a condenser, and a nitrogen introducing pipe were installed on the flask, and the flask was placed in a mantle heater. The mixture in the flask was reacted for 6 hours at 200° C. in a nitrogen atmosphere to yield a polyester resin. The polyester resin was subjected to molecular weight measurement by gel permeation chromatography (GPC) in the same manner as in the hybrid resin production example. Table 1 shows the results.

TABLE 1

| | Kind | Mw | Mn | Mw/Mn | Peak molecular weight |
|---|---|---|---|---|---|
| Resin A | Hybrid resin | 66000 | 4400 | 15 | 8500 |
| Resin B | Styrene-acrylic resin | 89000 | 6800 | 13 | 7800 |
| Resin C | Polyester resin | 9800 | 3300 | 3 | 8400 |

Toner Production Example 1

| | |
|---|---|
| Resin A (hybrid resin) | 100 parts by mass |
| C.I. Pigment Blue 15:3 | 5 parts by mass |
| Normal paraffin wax (maximum endothermic peak: 70° C., Mn: 380, Mw: 420) | 5 parts by mass |
| Aluminum 3,5-di-tert-butylsalicylate compound | 3 parts by mass |

The above materials were sufficiently premixed by using a Henschel mixer. After that, the mixture was melted and kneaded in a biaxial extruder at a barrel temperature of 120° C. The kneaded product was cooled and then coarsely pulverized into pieces each having a size of about 1 to 2 mm with a hammer mill. Next, the coarsely pulverized pieces were finely pulverized into pieces each having a particle diameter of 20 μm or less by using a pulverizer according to an air jet method. After that, the finely pulverized pieces were classified and spheroidized in an apparatus for simultaneously performing classification and a surface modification treatment using a mechanical impact force, thereby resulting in toner particles having a weight average particle diameter of 5.5 μm (classified products). Furthermore, 100 parts by mass of the toner particles (classified products) were added with 1.0 part by mass of hydrophobic silica (BET: 200 $m^2/g$) and 1.0 part by mass of titanium oxide fine particles surface-treated with isobutyl trimethoxysilane (BET: 80 $m^2/g$), and the whole was mixed by using a Henschel mixer (FM-75, manufactured by Mitsui Miike Kakoki) to produce a toner 1 having a weight average particle diameter of 5.5 μm.

The flow tester physical properties of the toner 1 were measured. The toner had a softening temperature Ts of 71° C., a flow starting temperature Tfb of 105° C., and a ½ method melting temperature $T_{1/2}$ of 131° C. Table 2 shows the values of the flow tester physical properties.

Toner Production Example 2

A toner 2 was produced in the same manner as in Toner Production Example 1 except that a normal paraffin wax having a maximum endothermic peak of 61° C. (Mn: 280, Mw: 360) was used as a release agent. Table 2 shows the flow tester physical properties of the toner 2.

Toner Production Example 3

A toner 3 was produced in the same manner as in Toner Production Example 1 except that a polypropylene wax having a maximum endothermic peak of 137° C. (Mn: 1,000, Mw: 5,100) was used as a release agent. Table 2 shows the flow tester physical properties of the toner 3.

Toner Production Example 4

A toner 4 was produced in the same manner as in Toner Production Example 1 except that a normal paraffin wax having a maximum endothermic peak of 58° C. (Mn: 220, Mw: 320) was used as a release agent. Table 2 shows the flow tester physical properties of the toner 4.

Toner Production Example 5

A toner 5 was produced in the same manner as in Toner Production Example 1 except that a polypropylene wax having a maximum endothermic peak of 141° C. (Mn: 1,000, Mw: 6,000) was used as a release agent. Table 2 shows the flow tester physical properties of the toner 5.

Toner Production Example 6

A toner 6 was produced in the same manner as in Toner Production Example 1 except that C.I. Pigment Blue 15:3 was changed to C.I. Pigment Yellow 74. Table 2 shows the flow tester physical properties of the toner 6.

Toner Production Example 7

A toner 7 was produced in the same manner as in Toner Production Example 1 except that C.I. Pigment Blue 15:3 was changed to C.I. Pigment Red 122. Table 2 shows the flow tester physical properties of the toner 7.

Toner Production Example 8

A toner 8 was produced in the same manner as in Toner Production Example 1 except that C.I. Pigment Blue 15:3 was changed to carbon black. Table 2 shows the flow tester physical properties of the toner 8.

Toner Production Example 9

A toner 9 was produced in the same manner as in Toner Production Example 1 using materials of Toner Production Example 8 except that: the resin B was used instead of the resin A; and a polyethylene wax having a maximum endothermic peak of 101° C. (Mn: 1,600, Mw: 2,500) was used as a release agent. Table 2 shows the flow tester physical properties of the toner 9.

Toner Production Example 10

A toner 10 was produced in the same manner as in Toner Production Example 1 using materials of Toner Production Example 5 except that the resin C was used instead of the resin A. Table 2 shows the flow tester physical properties of the toner 10.

Toner Production Example 11

710 parts of ion-exchanged water and 450 parts of a 0.1-mol/liter aqueous solution of $Na_3PO_4$ were charged into a 2-liter four-necked flask equipped with a high-speed stirring device TK Homomixer (manufactured by Tokushu Kika Kogyo Co., Ltd.), and the mixture was heated to 60° C. while the number of revolutions of the high-speed stirring device was adjusted to 10,000 rpm. 68 parts of a 1.0-mol/liter aqueous solution of $CaCl_2$ were gradually added to the mixture to prepare an aqueous dispersion medium containing a fine and hardly water-soluble dispersant $Ca_3(PO_4)_2$.

| | |
|---|---|
| Styrene | 165 parts |
| n-butyl acrylate | 35 parts |
| Divinylbenzene | 0.5 part |
| C.I. Pigment Blue 15:3 | 14 parts |
| Resin C (polyester resin) | 10 parts |
| Aluminum 3,5-di-tert-butylsalicylate compound | 2 parts |
| Aliphatic hydrocarbon-based ester wax (maximum endothermic peak: 68° C., Mn: 1,050, Mw: 1,200) | 20 parts |

In the meantime, the above raw materials were dispersed by using an atliter (manufactured by Mitsui Mining and Smelting Co., Ltd.) for 3 hours. After that, 10 parts of 2,2'-azobis(2,4-dimethylvaleronitrile) as a polymerization initiator were added to the resultant to prepare a polymerizable monomer composition. Next, the polymerizable monomer composition was placed into the aqueous dispersion medium, and the mixture was granulated while the number of revolutions of the high-speed stirring device was maintained at 10,000 rpm. After that, the resultant was reacted at 70° C. for 2 hours while being stirred with a paddle stirring blade. After that, the resultant was polymerized at 90° C. for 10 hours.

After the completion of the reaction, the suspension was cooled and added with dilute hydrochloric acid to dissolve the hardly water-soluble dispersant, and the whole was then filtered, washed with water, and dried. Then, the resultant was classified to a desired particle size through air classification to produce toner particles. The particles described above were externally added to the resultant toner particles in the same manner as in Toner Production Example 1 to produce a toner 11. Table 2 shows the flow tester physical properties of the toner 11.

Toner Production Example 12

Preparation of Resin Particle Dispersion 1

| | |
|---|---|
| Styrene | 370 g |
| n-butyl acrylate | 30 g |
| Acrylic acid | 6 g |
| Dodecanethiol | 24 g |
| Carbon tetrabromide | 4 g |

The above materials were mixed and dissolved. In a flask, the resultant was dispersed and emulsified into 550 g of ion-exchanged water into which 6 g of a nonionic surfactant and 10 g of an anionic surfactant had been dissolved, and the whole was slowly mixed for 10 minutes. During the mixing, 50 g of ion-exchanged water into which 4 g of ammonium persulfate had been dissolved were added to the mixture, followed by nitrogen substitution. After that, the contents in the flask were heated up to 70° C. in an oil bath while they were stirred. Then, emulsion polymerization was continued for 5 hours without any treatment to prepare a resin particle dispersion 1 having an average particle diameter of 150 nm, a Tg of 62° C., and a weight average molecular weight (Mw) of 12,000.

Preparation of Resin Particle Dispersion 2

| | |
|---|---|
| Styrene | 280 g |
| n-butyl acrylate | 120 g |
| Acrylic acid | 8 g |

The above materials were mixed and dissolved. In a flask, the resultant was dispersed and emulsified into 550 g of ion-exchanged water into which 6 g of a nonionic surfactant and 12 g of an anionic surfactant had been dissolved, and the whole was slowly mixed for 10 minutes. During the mixing, 50 g of ion-exchanged water into which 3 g of ammonium persulfate had been dissolved were added to the mixture, followed by nitrogen substitution. After that, the contents in the flask were heated up to 70° C. in an oil bath while they were stirred. Then, emulsion polymerization was continued for 5 hours without any treatment to prepare a resin particle dispersion 2 having an average particle diameter of 110 nm, a glass transition point of 55° C., and a weight average molecular weight (Mw) of 550,000.

Preparation of Release agent Particle Dispersion 1

| | |
|---|---|
| Polyethylene wax (maximum endothermic peak: 98° C., Mn: 1,050, Mw: 2,100) | 50 g |
| Anionic surfactant | 5 g |
| Ion-exchanged water | 200 g |

The above materials were heated to 95° C., and were dispersed by using a homogenizer or the like. Then, the resultant was subjected to a dispersion treatment by means of a pressure ejection type homogenizer to prepare a release agent particle dispersion 1 obtained by dispersing a release agent having an average particle diameter of 570 nm.

Preparation of Colorant Particle Dispersion 1

| | |
|---|---|
| C.I. Pigment Blue 15:3 | 20 g |
| Anionic surfactant | 2 g |
| Ion-exchanged water | 78 g |

The above materials were mixed, and the mixture was dispersed for 10 minutes by means of an ultrasonic washer at an oscillatory frequency of 26 kHz to prepare a colorant particle dispersion (anionic) 1.

Preparation of Mixed Liquid

| | |
|---|---|
| Resin particle dispersion 1 | 180 g |
| Resin particle dispersion 2 | 80 g |
| Colorant particle dispersion 1 | 30 g |
| Release agent particle dispersion 1 | 50 g |

The above dispersions were mixed and dispersed in a round-bottomed flask made of stainless steel by using a homogenizer or the like to prepare a mixed liquid.

Formation of Agglomerate Particles 1.5 g of a cationic surfactant as an agglomerate reagent were added to the mixed liquid in a flask, and the mixture was heated to 50° C. while being stirred in an oil bath for heating. After the temperature had been kept at 50° C. for 1 hour, the resultant was observed with an optical microscope. The observation confirmed that agglomerate particles having a weight average particle diameter of about 6.1 μm were formed.

Fusion

After that, 3 g of an anionic surfactant were added to the resultant, and the flask made of stainless steel was hermetically sealed. While stirring was continued by means of a magnetic seal, the resultant was heated to 105° C. and kept at the temperature for 3 hours. The resultant was cooled, and then the reaction product was filtered, sufficiently washed with ion-exchanged water, and dried to prepare toner particles. The particles described above were externally added to the resultant toner particles in the same manner as in Toner Production Example 1 to produce a toner 12. Table 2 shows the flow tester physical properties of the toner 12.

Example 1

Cu—Zn ferrite carrier particles surface coated with a silicone resin (number average particle diameter: 50 μm, intensity of magnetization in 79.6 kA/m: 60 $Am^2/kg$, specific gravity: 5.0 $g/cm^3$) and the toner 1 were added with each other in such a manner that the toner concentration would be 8 mass %, and the whole was mixed by means of a turbler mixer to prepare a developer.

Subsequently, an external fixing device (a fixing device A in FIG. 6) was prepared by arranging a belt nip type fixing unit (FIG. 2) and a roller nip type fixing unit (FIG. 1) with a distance between fixing unit nips of 500 mm. The nip width and linear pressure of a first fixing unit were adjusted to 35 mm and 3.5 kgf/mm, respectively, while the nip width and linear pressure of a second fixing unit were adjusted to 10 mm and 10.0 kgf/mm, respectively, and the temperature of each fixing unit was adjusted. In addition, the 10-point average roughness of the surface of each of a heating body and a pressurizing body used was 1 μm or less. Neither fixing unit had a mechanism for applying oil for preventing offset. When a recording medium was allowed to pass through the fixing device at a recording medium conveying speed of 350 mm/sec, the maximum temperature T1 on the recording medium when the recording medium passed through the first fixing unit became 140° C., the maximum temperature T2 on the recording medium when the recording medium passed through the second fixing unit became 152° C., and the minimum temperature t on the recording medium during a time period commencing on ejection of the recording medium from the first fixing unit and ending on entry of the recording medium into the second fixing unit became 121° C. Table 3 shows the temperatures T1, T2, and t on the recording medium.

Next, in a reconstructed device of a color copying machine CLC1000 (manufactured by CANON Inc.) obtained by removing a fixing unit from the machine, in a monochrome mode, and in a normal-temperature-and-normal-humidity environment (23° C./60%), a developing contrast was adjusted in such a manner that the toner mounting amount on a recording medium would be 1.3 $mg/cm^2$ at the time of output of a solid image. Then, an unfixed solid image was formed on A4 size paper (SK80 recommended by CLC, gloss 50) up to a portion having an image area ratio of 25% with a tip margin of 5 mm. The unfixed image was allowed to pass through the fixing device A adjusted to the conditions shown in Table 3, to thereby obtain a fixed image. At that time, the image was evaluated with the eyes for offset property and separability. In addition, gloss and fixation strength of the resultant fixed image were measured.

As a result of the evaluation, neither offset nor winding to a fixing member occurred, and smooth images each of which had high gloss, experienced no reduction in density due to a rubbing test, and had no rough sense were continuously obtained. Table 4 shows the results of the evaluations.

Evaluation items and evaluation criteria are shown below.

a. Gloss

The gloss of the fixed image obtained as described above was measured. 5 points were measured: a center of an image portion at a front end in a traveling direction of paper, a center of an image portion at a rear end in the traveling direction of paper, a central portion, and a midpoint between each of the ends and the central portion.

A: 20% or more

B: 15% or more and less than 20%

C: 10% or more and less than 15%

D: Less than 10% b. Fixation Strength

The fixed image obtained as described above was evaluated for fixation strength as follows. First, the image density of the central portion was measured. Then, the fixed image was rubbed with lens-cleaning paper (5 reciprocations) applying a load of 4.9 kPa (50 $g/cm^2$) to the portion whose image density had been measured, and the image density was measured again. A rate of reduction in image density before and after the rubbing (%) was measured.

A: A rate of reduction in density of less than 1%

B: A rate of reduction in density of less than 5%

C: A rate of reduction in density of less than 10%

D: A rate of reduction in density of 10% or more c. Offset Resistance

The degree of offset when the fixed image obtained as described above was allowed to pass through the fixing device A by means of transfer paper for carrying the image was evaluated as below by visually observing the contamination of a non-image portion.

A: No offset occurs.

B: Slight offset occurs, but is practically acceptable.

C: Offset occurs.

D: Offset remarkably occurs.

d. Separability

In a reconstructed device of a color copying machine CLC1000 (manufactured by CANON Inc.) obtained by removing a fixing unit from the machine, in a monochrome mode, and in a normal-temperature-and-normal-humidity environment (23° C./60%), a developing contrast was adjusted in such a manner that the toner mounting amount on paper would be 1.3 mg/cm$^2$. Then, an unfixed image having an image area ratio of 100% was formed on A4 paper (SK80 recommended by CLC) with a tip margin of 1 mm. The unfixed image was allowed to pass through the fixing device A adjusted to the conditions shown in Table 3, and was evaluated for separability (winding property).

A: Separable without any problem.

B: Separable with a slight possibility of winding. (a fixed image is discharged diagonally upward at the time of separation).

C: Slight winding occurs.

D: Winding occurs.

e. Curl and Conveyance Failure

In a reconstructed device of a color copying machine CLC1000 (manufactured by CANON Inc.) obtained by removing a fixing unit from the machine, in a monochrome mode, and in a normal-temperature-and-normal-humidity environment (23° C./60%), a developing contrast was adjusted in such a manner that the toner mounting amount on paper would be 1.3 mg/cm$^2$. Then, 10 unfixed images each having an image area ratio of 100% were formed on A4 paper (SK80 recommended by CLC) with a tip margin of 5 mm. The unfixed images were allowed to pass through the fixing device A adjusted to the conditions shown in Table 3 in order, and the number of occurrence of conveyance failure was counted.

A: An image passed through a fixing device without any problem.

B: After an image had passed through a first fixing unit, slight curl was observed, but the image passed through a second fixing unit without any problem.

C: After an image had passed through a first fixing unit, curl occurred, and 10% or less of a recording medium could not enter a second fixing unit.

D: After an image had passed through a first fixing unit, curl occurred, and more than 10% a recording medium could not enter a second fixing unit.

f. Gloss Uniformity

Gloss uniformity was evaluated according to the following procedure.

In a reconstructed device of a color copying machine CLC1000 (manufactured by CANON Inc.) obtained by removing a fixing unit from the machine, in a monochrome mode, and in a normal-temperature-and-normal-humidity environment (23° C./60%), an image set in 17 gray levels in such a manner that a toner mounting amount per unit area would be at a substantially equal interval in the range of 0.05 to 0.6 mg/cm$^2$, and in which solid images (1 cm×29 cm) at respective toner mounting amounts were arranged in the horizontal direction of A4 was outputted on coat paper (CANON, GLOSSY Brochure Paper: basic weight 148 g/m$^2$, gloss on a recording medium: 50). The unfixed image was allowed to pass through the fixing device A adjusted to the conditions shown in Table 3, and was measured gloss of each gray levels, to evaluate for image gloss uniformity. Neither fixing unit had a mechanism for applying oil for preventing offset.

In measuring gloss, in the same manner as in image gloss described above, a reflection light quantity in a 60° direction was measured by means of a VG-10 glossmeter (manufactured by Nippon Denshoku). The gloss of a belt image for each mounting amount was measured, and the gloss of a belt having a maximum gloss was denoted by Gmax, and the gloss of a belt having a minimum gloss was denoted by Gmin. Gloss uniformity was evaluated according to a difference ΔG between Gmax and Gmin. The evaluation criteria for gloss uniformity are shown below.

A: Less than 10

B: 10 or more and less than 20

C: 20 or more and less than 30

D: 30 or more

Example 2

Figure 6:
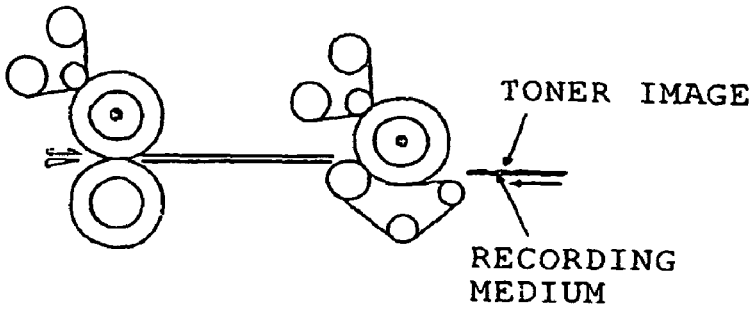
FIG. 6 is a schematic view of a fixing device used in each of Examples.
Figure 6:
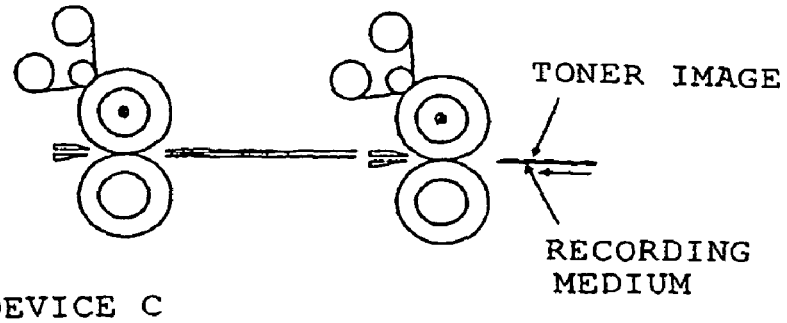
Figure 6:
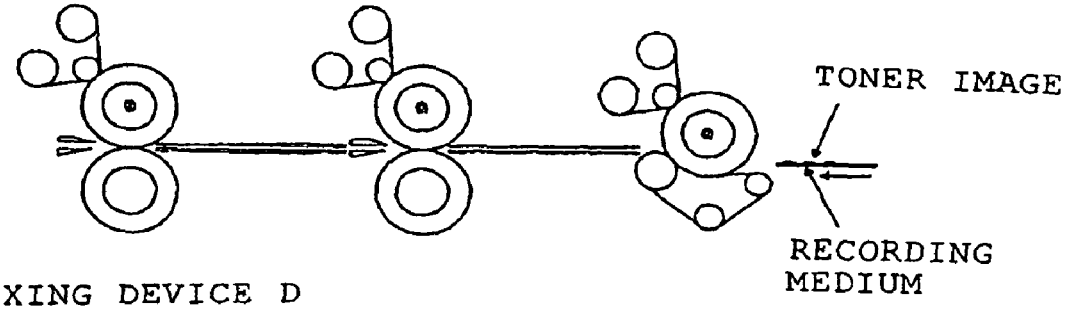
Figure 6:
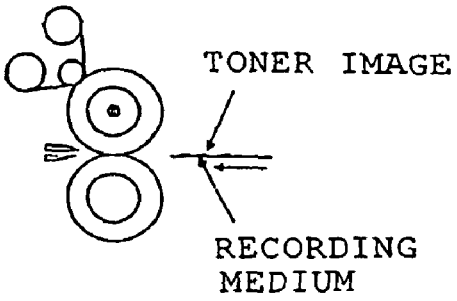

A fixing device C shown in FIG. 6 was used as a fixing device, the temperature of the fixing device was adjusted in such a manner that the temperatures on a recording medium would be those shown in Table 3, and evaluation was performed in the same manner as in Example 1. The external fixing device C was prepared by arranging a belt nip type fixing unit (FIG. 2) and 2 roller nip-type fixing units (FIG. 1) with each distance between adjacent 2 nip type fixing unit of 500 mm, a nip of a first fixing unit of 35 mm, a nip of a second fixing unit of 10 mm, and a nip of a third fixing unit of 10 mm. Neither fixing unit had a mechanism for applying oil for preventing offset. The temperature of each fixing unit was adjusted. When an unfixed image on a recording medium was allowed to pass through the fixing device at a recording medium conveying speed of 500 mm/sec$^{-1}$, the maximum temperature T1 on the recording medium before and after the recording medium passed through the first fixing unit became 145° C., the maximum temperature T2 on the recording medium before and after the recording medium passed through the second fixing unit became 155° C., the maximum temperature T3 on the recording medium before and after the recording medium passed through the third fixing unit became 150° C., and the minimum temperature t on the recording medium during a time period commencing on ejection of the recording medium from the first fixing unit and ending on entry of the recording medium into the second fixing unit became 120° C. Table 3 shows the temperatures T1, T2, T3, and t on the recording medium.

Neither offset nor winding to a fixing member occurred, and images each of which had high gloss, and experienced no reduction in density due to a rubbing test were continuously obtained. The images each had a small difference in gloss irrespective of a mounting amount, and had high image gloss uniformity. In addition, the images each had a very small difference between recording medium gloss and image gloss, that is, the images each had uniform gloss. Table 4 shows the results of the evaluations.

Example 3

Evaluation was performed in the same manner as in Example 1 except that the temperature conditions of the fixing device A were adjusted in such a manner that the temperatures on a recording medium would be those shown in Example 3 of Table 3. A practically acceptable image was obtained, although it was very slightly inferior in gloss, gloss uniformity, and fixation strength to that of Example 1. Table 4 shows the results of the evaluation.

Example 4

Evaluation was performed in the same manner as in Example 1 except that: the belt nip type fixing unit (FIG. 2) and the roller nip type fixing unit (FIG. 1) in the fixing device A were arranged with a distance between their nips of 1,000 mm; and the temperature conditions of the fixing device A were adjusted in such a manner that the temperatures on a recording medium would be those shown in Example 4 of Table 3. A practically acceptable image was obtained, although it was very slightly inferior in fixation strength and gloss uniformity to that of Example 1. In addition, any conveyance failure of a recording medium was not observed, although very slightly curl occurred. Table 4 shows the results of the evaluation.

Example 5

Evaluation was performed in the same manner as in Example 1 except that the temperature conditions of the fixing device A were adjusted in such a manner that the temperatures on a recording medium would be those shown in Example 5 of Table 3. A practically acceptable image was obtained, although it was very slightly inferior in gloss and gloss uniformity to that of Example 1. Table 4 shows the results of the evaluation.

Example 6

Evaluation was performed in the same manner as in Example 1 except that the temperature conditions of the fixing device A were adjusted in such a manner that the temperatures on a recording medium would be those shown in Example 6 of Table 3. A practically acceptable image was obtained, although it was very slightly inferior in gloss and gloss uniformity to that of Example 1. Table 4 shows the results of the evaluation.

Example 7

Evaluation was performed in the same manner as in Example 1 except that: the toner 2 was used as toner; and the temperature conditions of the fixing device A were adjusted in such a manner that the temperatures on a recording medium would be those shown in Example 7 of Table 3. Slight offset was observed, but was practically acceptable. The resultant image had no concern about gloss and other evaluation criteria. Table 4 shows the results of the evaluation.

Example 8

Evaluation was performed in the same manner as in Example 1 except that: the toner 3 was used as toner; and the temperature conditions of the fixing device A were adjusted in such a manner that the temperatures on a recording medium would be those shown in Example 8 of Table 3. The resultant image was very slightly inferior in gloss to that of Example 1, and very slight offset was observed. However, the offset was practically acceptable, and the image was also practically acceptable. Table 4 shows the results of the evaluation.

Example 9

Evaluation was performed in the same manner as in Example 1 except that: the toner 4 was used as toner; and the temperature conditions of the fixing device A were adjusted in such a manner that the temperatures on a recording medium would be those shown in Example 9 of Table 3. A practically acceptable image was obtained, although it was slightly inferior in offset and separability to that of Example 1. The image had no concern about image gloss and gloss uniformity. Table 4 shows the results of the evaluation.

Example 10

Evaluation was performed in the same manner as in Example 1 except that: the toner 5 was used as toner; and the temperature conditions of the fixing device A were adjusted in such a manner that the temperatures on a recording medium would be those shown in Example 10 of Table 3. A practically acceptable image was obtained, although it was slightly inferior in offset and separability to that of Example 1. The gloss of the image was somewhat lower than that of Example 1, but the image had no concern about gloss uniformity. Table 4 shows the results of the evaluation.

Example 11

Evaluation was performed in the same manner as in Example 1 except that the temperature conditions of the fixing device A were adjusted in such a manner that the temperatures on a recording medium would be those shown in Example 11 of Table 3. A practically acceptable image was obtained, although it was inferior in gloss, gloss uniformity, and fixation strength to that of Example 1. Slight curl occurred, and the image was slightly inferior in conveyance to that of Example 1. Table 4 shows the results of the evaluation.

Example 12

Evaluation was performed in the same manner as in Example 1 except that the temperature conditions of the fixing device A were adjusted in such a manner that the temperatures on a recording medium would be those shown in Example 12 of Table 3. A practically acceptable image was obtained, although it was somewhat inferior in gloss and gloss uniformity to that of Example 1. Table 4 shows the results of the evaluation.

Example 13

Evaluation was performed in the same manner as in Example 1 except that the temperature conditions of the fixing device A were adjusted in such a manner that the temperatures on a recording medium would be those shown in Example 13 of Table 3. Although separability was somewhat inferior to Example 1, it was practically acceptable. The image had no concern about gloss and the like. Table 4 shows the results of the evaluation.

Example 14

Evaluation was performed in the same manner as in Example 1 except that the temperature conditions of the fixing device A were adjusted in such a manner that the temperatures on a recording medium would be those shown in Example 14 of Table 3. Although separability was somewhat inferior to Example 1, it was practically acceptable. The image had no concern about gloss and the like. Table 4 shows the results of the evaluation.

Example 15

Evaluation was performed in the same manner as in Example 1 except that the temperature conditions of the fixing device A were adjusted in such a manner that the temperatures on a recording medium would be those shown in Example 15 of Table 3. Although offset and separability was somewhat inferior to Example 1, it was practically acceptable. The image had no concern about gloss and the like. Table 4 shows the results of the evaluation.

Example 16

Evaluation was performed in the same manner as in Example 1 except that: the toner 6 was used as toner; and the temperature conditions of the fixing device A were adjusted in such a manner that the temperatures on a recording medium would be those shown in Example 16 of Table 3. A practically acceptable image was obtained, although it was slightly inferior in offset and separability to that of Example 1. The image had a gloss uniformity ΔG of 15, so the image had bad uniformity as compared to that of Example 1. Table 4 shows the results of the evaluation.

Example 17

Evaluation was performed in the same manner as in Example 1 except that: the toner 7 was used as toner; and the temperature conditions of the fixing device A were adjusted in such a manner that the temperatures on a recording medium would be those shown in Example 17 of Table 3. The image had a gloss uniformity ΔG of 11, and although gloss uniformity was slightly inferior to Example 1, it was practically acceptable. Table 4 shows the results of the evaluation.

Example 18

Evaluation was performed in the same manner as in Example 1 except that: the toner 8 was used as toner; and the temperature conditions of the fixing device A were adjusted in such a manner that the temperatures on a recording medium would be those shown in Example 18 of Table 3. Although gloss uniformity was slightly inferior to Example 1, it was practically acceptable. Table 4 shows the results of the evaluation.

Example 19

Evaluation was performed in the same manner as in Example 1 except that: the toner 5 was used as toner; a fixing device B shown in FIG. 6 was used as an external fixing device, in which 2 roller nip type fixing units (FIG. 1) were arranged with the fixing nip of each fixing unit adjusted to 10 mm and a distance between fixing unit nips of 500 mm; and the temperature of the fixing device was adjusted in such a manner that the temperatures on a recording medium would be those shown in Table 3. Neither fixing unit had a mechanism for applying oil for preventing offset. The resultant image was slightly inferior in gloss uniformity to that of Example 1, and had bad offset, separability, and degree of curl as compared to that of Example 1. Table 4 shows the results of the evaluation.

Example 20

Evaluation was performed in the same manner as in Example 1 except that: the toner 9 was used as toner; the fixing device B identical to that of Example 19 was prepared; and the temperature conditions of the fixing device B were adjusted in such a manner that the temperatures on a recording medium would be those shown in Example 20 of Table 3. The resultant image was slightly inferior in gloss uniformity to that of Example 1, but the offset managed to be practically acceptable. Table 4 shows the results of the evaluation.

Example 21

Evaluation was performed in the same manner as in Example 1 except that: the toner 10 was used as toner; the fixing device B identical to that of Example 19 was prepared; and the temperature conditions of the fixing device B were adjusted in such a manner that the temperatures on a recording medium would be those shown in Example 21 of Table 3. The resultant image had high gloss as compared to that of Example 1, but was slightly inferior in gloss uniformity to that of Example 1. In addition, Gmax was high with respect to recording medium gloss, so the image had a sense of incongruity. Furthermore, the image had concerns about offset, separability, and conveyance, but was surely practically acceptable. Table 4 shows the results of the evaluation.

Example 22

Evaluation was performed in the same manner as in Example 1 except that: the toner 11 was used as toner; the fixing device B identical to that of Example 19 was prepared; and the temperature conditions of the fixing device B were adjusted in such a manner that the temperatures on a recording medium would be those shown in Example 22 of Table 3. Gloss and gloss uniformity managed to be acceptable. The resultant image had concerns about fixation strength, offset, separability, and conveyance, but managed to be practically acceptable. Table 4 shows the results of the evaluation.

Example 23

Evaluation was performed in the same manner as in Example 1 except that: the toner 12 was used as toner; the fixing device B identical to that of Example 19 was prepared; and the temperature conditions of the fixing device B were adjusted in such a manner that the temperatures on a recording medium would be those shown in Example 23 of Table 3. Gloss and gloss uniformity managed to be acceptable. The resultant image had concerns about fixation strength, offset, separability, and conveyance, but managed to be practically acceptable. Table 4 shows the results of the evaluation.

Comparative Example 1

Evaluation was performed in the same manner as in Example 1 except that: the toner 12 was used as toner; a fixing device D shown in FIG. 6 was used as an external fixing device, in which a roller nip type fixing unit (FIG. 1) was arranged; and the temperature of the fixing device was adjusted in such a manner that the temperatures on a recording medium would be those shown in Table 3. The fixing unit had no mechanism for applying oil for preventing offset. The resultant image had insufficient gloss, and a large difference in gloss depending on a toner mounting amount, so it was poor in gloss uniformity. In addition, a difference between image gloss and recording medium gloss was large, so the image had a considerable sense of incongruity. In addition, the image was poor in fixation strength, offset, separability, and the like. Table 4 shows the results of the evaluation.

Comparative Example 2

Evaluation was performed in the same manner as in Example 1 except that: the toner 12 was used as toner; the fixing device B identical to that of Example 19 was prepared; and the temperature conditions of the fixing device B were adjusted in such a manner that the temperatures on a recording medium would be those shown in Comparative Example 2 of Table 3. The resultant image had insufficient gloss, and a large difference in gloss depending on a toner mounting amount, so it was poor in gloss uniformity. In addition, a difference between image gloss and recording medium gloss was large, so the image had a considerable sense of incongruity. In addition, the image was poor in fixation strength, offset, separability, and the like. Table 4 shows the results of the evaluation.

Comparative Example 3

Evaluation was performed in the same manner as in Example 1 except that: the toner 12 was used as toner; the 2 roller nip type fixing units (FIG. 1) in the fixing device B of Example 19 were arranged with a distance between their nips of 1,000 mm; and the temperature conditions of the fixing device B were adjusted in such a manner that the temperatures on a recording medium would be those shown in Comparative Example 3 of Table 3. The resultant image had insufficient gloss, and a large difference in gloss depending on a toner mounting amount, so it was poor in gloss uniformity. In addition, a difference between image gloss and recording medium gloss was large, so the image had a considerable sense of incongruity. In addition, the image was poor in fixation strength, offset, separability, and the like. Table 4 shows the results of the evaluation.

Comparative Example 4

Evaluation was performed in the same manner as in Example 1 except that: the toner 11 was used as toner; the fixing device B identical to that of Example 19 was prepared; and the temperature conditions of the fixing device B were adjusted in such a manner that the temperatures on a recording medium would be those shown in Comparative Example 4 of Table 3. The resultant image had insufficient gloss, and a large difference in gloss depending on a toner mounting amount, so it was poor in gloss uniformity. In addition, a difference between image gloss and recording medium gloss was large, so the image had a considerable sense of incongruity. In addition, the image was poor in fixation strength, offset, separability, and the like. Table 4 shows the results of the evaluation.

Comparative Example 5

Evaluation was performed in the same manner as in Example 1 except that: the toner 10 was used as toner; the fixing device B identical to that of Example 19 was prepared; each fixing unit in the fixing device B was provided with a mechanism for applying silicone oil; and the temperature conditions of the fixing device B were adjusted in such a manner that the temperatures on a recording medium would be those shown in Comparative Example 5 of Table 3. The resultant image had high gloss, but had a large difference in gloss depending on a toner mounting amount, so it was poor in gloss uniformity. In addition, a difference between image gloss and recording medium gloss was large, so the image had a considerable sense of incongruity. In addition, the image was poor in fixation strength, offset, separability, and the like. Table 4 shows the results of the evaluation.

Example 24

A full-color image having a toner mounting amount of 1.3 $mg/cm^2$ was formed by using a developer containing the cyan toner prepared in Example 1, a developer containing the yellow toner prepared in Example 16, a developer containing the magenta toner prepared in Example 17, a developer containing the black toner prepared in Example 18, and an apparatus having the same construction as that of Example 1. Evaluation was performed in the same manner as in Example 1. As a result, neither offset nor winding to a fixing member occurred, and an smooth image which was excellent in color-mixing ability, had high gloss, experienced no reduction in density due to a rubbing test, and had no rough sense was obtained.

TABLE 2

| | Toner production method | Binder resin | Colorant | Releasing agent | maximum endothermic peak(° C.) | Softening temperature Ts(° C.) | Flow starting temperature Tfb(° C.) | ½ method melting temperature $T_{1/2}$(° C.) |
|---|---|---|---|---|---|---|---|---|
| Toner 1 | Pulverization | ResinA | C.I. Pigment Blue15:3 | Paraffin | 70 | 71 | 105 | 131 |
| Toner 2 | Pulverization | ResinA | C.I. Pigment Blue15:3 | Paraffin | 61 | 70 | 106 | 132 |
| Toner 3 | Pulverization | ResinA | C.I. Pigment Blue15:3 | Polypropylene | 137 | 73 | 105 | 132 |
| Toner 4 | Pulverization | ResinA | C.I. Pigment Blue15:3 | Paraffin | 58 | 71 | 108 | 136 |
| Toner 5 | Pulverization | ResinA | C.I. Pigment Blue15:3 | Polypropylene | 141 | 73 | 109 | 137 |
| Toner 6 | Pulverization | ResinA | C.I. Pigment Yellow 74 | Paraffin | 70 | 70 | 105 | 130 |
| Toner 7 | Pulverization | ResinA | C.I. Pigment Red122 | Paraffin | 70 | 71 | 105 | 130 |
| Toner 8 | Pulverization | ResinA | Carbon black | Paraffin | 70 | 70 | 106 | 131 |
| Toner 9 | Pulverization | ResinB | Carbon black | Polyethylene | 101 | 76 | 116 | 153 |
| Toner 10 | Pulverization | ResinC | C.I. Pigment Blue15:3 | Polypropylene | 141 | 75 | 122 | 135 |
| Toner 11 | Suspension polymerization | — | C.I. Pigment Blue15:3 | Ester | 68 | 73 | 144 | 180 |
| Toner 12 | Emulsion aggregation | — | C.I. Pigment Blue15:3 | Polyethylene | 98 | 68 | 106 | 134 |

TABLE 3

| | Toner | Ts (° C.) | Tfb (° C.) | $T_{1/2}$ (° C.) | Fixing device | Recording medium conveying speed (mm · $s^{-1}$) | Distance between fixing units (mn) | T1 (° C.) | t (° C.) | T2 (° C.) | T3 (° C.) | Equation (1) | Equation (2) | Equation (3) |
|---|---|---|---|---|---|---|---|---|---|---|---|---|---|---|
| Example 1 | Toner1 | 71 | 105 | 131 | A | 350 | 500 | 140 | 121 | 152 | — | T1 > Tfb | T2 > t > Ts | T2 > $T_{1/2}$ |
| Example 2 | Toner1 | 71 | 105 | 131 | C | 500 | ↑ | 145 | 120 | 155 | 150 | ↑ | ↑ | ↑ |
| Example 3 | Toner1 | 71 | 105 | 131 | A | 350 | ↑ | 111 | 104 | 152 | — | ↑ | ↑ | ↑ |
| Example 4 | Toner1 | 71 | 105 | 131 | A | 350 | 1000 | 140 | 75 | 134 | — | ↑ | ↑ | ↑ |
| Example 5 | Toner1 | 71 | 105 | 131 | A | 360 | 500 | 140 | 136 | 141 | — | ↑ | ↑ | ↑ |
| Example 6 | Toner1 | 71 | 105 | 131 | A | 350 | ↑ | 140 | 220 | 120 | — | ↑ | ↑ | T2 < $T_{1/2}$ |
| Example 7 | Toner2 | 70 | 106 | 132 | A | 350 | ↑ | 140 | 120 | 155 | — | ↑ | ↑ | T2 > $T_{1/2}$ |
| Example 8 | Toner3 | 73 | 105 | 132 | A | 350 | ↑ | 140 | 120 | 155 | — | ↑ | ↑ | ↑ |
| Example 9 | Toner4 | 71 | 108 | 136 | A | 350 | ↑ | 140 | 120 | 155 | — | ↑ | ↑ | ↑ |
| Example 10 | Toner5 | 73 | 109 | 137 | A | 350 | ↑ | 140 | 120 | 155 | — | ↑ | ↑ | ↑ |
| Example 11 | Toner1 | 71 | 105 | 131 | A | 350 | ↑ | 108 | 102 | 152 | — | ↑ | ↑ | ↑ |
| Example 12 | Toner1 | 71 | 105 | 131 | A | 350 | ↑ | 158 | 140 | 155 | — | ↑ | ↑ | ↑ |
| Example 13 | Toner1 | 71 | 105 | 131 | A | 350 | ↑ | 162 | 142 | 155 | — | ↑ | ↑ | ↑ |
| Example 14 | Toner1 | 71 | 105 | 131 | A | 350 | ↑ | 140 | 130 | 188 | — | ↑ | ↑ | ↑ |
| Example 15 | Toner1 | 71 | 105 | 131 | A | 350 | ↑ | 140 | 137 | 195 | — | ↑ | ↑ | ↑ |
| Example 16 | Toner6 | 70 | 105 | 130 | A | 350 | ↑ | 140 | 125 | 188 | — | ↑ | ↑ | ↑ |
| Example 17 | Toner7 | 70 | 105 | 130 | A | 350 | ↑ | 140 | 137 | 148 | — | ↑ | ↑ | ↑ |
| Example 18 | Toner8 | 71 | 105 | 130 | A | 350 | ↑ | 140 | 137 | 144 | — | ↑ | ↑ | ↑ |
| Example 19 | Toner5 | 73 | 109 | 137 | B | 350 | ↑ | 145 | 130 | 165 | — | ↑ | ↑ | ↑ |
| Example 20 | Toner9 | 75 | 116 | 153 | B | 350 | ↑ | 145 | 130 | 165 | — | ↑ | ↑ | ↑ |
| Example 21 | Toner10 | 68 | 88 | 116 | B | 350 | ↑ | 145 | 130 | 165 | — | ↑ | ↑ | ↑ |
| Example 22 | Toner11 | 73 | 144 | 180 | B | 350 | ↑ | 145 | 130 | 165 | — | ↑ | ↑ | T2 < T½ |
| Example 23 | Toner12 | 68 | 106 | 134 | B | 350 | ↑ | 145 | 130 | 165 | — | ↑ | ↑ | T2 > T½ |
| Comparative Example 1 | Toner12 | 68 | 105 | 134 | D | 350 | ↑ | 185 | — | — | — | ↑ | — | — |
| Comparative Example 2 | Toner12 | 68 | 106 | 134 | B | 350 | ↑ | 145 | 137 | 132 | — | T1 > Tfb | T2 < t, t > Ts | T2 < $T_{1/2}$ |
| Comparative Example 3 | Toner12 | 68 | 106 | 134 | B | 350 | 1000 | 145 | 65 | 139 | — | ↑ | T2 > t, t < Ts | T2 > $T_{1/2}$ |
| Comparative Example 4 | Toner11 | 73 | 144 | 180 | B | 350 | 500 | 140 | 70 | 141 | — | T1 < Tfb | ↑ | T2 < $T_{1/2}$ |
| Comparative Example 5 | Toner10 | 68 | 88 | 116 | B | 350 | ↑ | 85 | 70 | 160 | — | ↑ | T2 > t > Ts | T2 > $T_{1/2}$ |

TABLE 4

| | Gloss | Gloss uniformity (ΔG) | Gmin | Gmax | Fixation strength | Offset resistance | Separability | Conveyance failure Curl |
|---|---|---|---|---|---|---|---|---|
| Example 1 | A (26%) | A (3) | 48 | 51 | A (0.1%) | A | A | A |
| Example 2 | A (25%) | A (5) | 48 | 53 | A (0.1%) | A | A | A |
| Example 3 | A (20%) | A (9) | 45 | 54 | B (2.2%) | A | A | A |
| Example 4 | A (25%) | A (5) | 44 | 49 | B (1.8%) | A | A | B |
| Example 5 | A (22%) | A (7) | 45 | 52 | A (0.2%) | A | A | A |
| Example 6 | A (22%) | A (8) | 48 | 56 | A (0.2%) | A | A | A |
| Example 7 | A (26%) | A (5) | 51 | 56 | A (0.2%) | B | A | A |
| Example 8 | A (20%) | A (4) | 48 | 52 | A (0.2%) | B | A | A |
| Example 9 | A (25%) | A (5) | 49 | 54 | A (0.2%) | B | B | A |
| Example 10 | A (20%) | A (5) | 49 | 54 | A (0.2%) | B | B | A |
| Example 11 | B (18%) | B (11) | 43 | 54 | B (3.5%) | A | A | B |
| Example 12 | A (22%) | A (6) | 48 | 54 | A (0.2%) | A | A | A |
| Example 13 | A (24%) | A (8) | 45 | 53 | A (0.2%) | A | B | A |
| Example 14 | A (23%) | A (9) | 49 | 53 | A (0.2%) | A | B | A |
| Example 15 | A (24%) | B (11) | 44 | 53 | A (0.2%) | B | B | A |
| Example 16 | A (24%) | B (15) | 40 | 55 | A (0.2%) | B | B | A |
| Example 17 | A (22%) | B (11) | 46 | 57 | A (0.2%) | A | A | A |
| Example 18 | A (20%) | A (9) | 45 | 54 | A (0.2%) | A | A | A |
| Example 19 | A (20%) | B (15) | 44 | 59 | A (0.2%) | B | B | B |
| Example 20 | B (18%) | B (16) | 38 | 54 | A (0.2%) | C | B | B |
| Example 21 | A (24%) | B (19) | 51 | 70 | A (0.8%) | C | B | B |
| Example 22 | C (13%) | C (22) | 27 | 45 | B (4.0%) | C | C | B |
| Example 23 | C (11%) | C (25) | 20 | 45 | C (8.0%) | C | C | B |
| Comparative Example 1 | D (8%) | D (31) | 11 | 42 | D (15.0%) | C | D | B |
| Comparative Example 2 | D (8%) | D (34) | 14 | 48 | C (9.0%) | C | C | A |
| Comparative Example 3 | C (10%) | D (32) | 14 | 46 | C (9.0%) | C | C | D |
| Comparative Example 4 | D (6%) | D (32) | 12 | 44 | D (12.0%) | C | C | D |

TABLE 4-continued

| | Gloss | Gloss uniformity (ΔG) | Gmin | Gmax | Fixation strength | Offset resistance | Separability | Conveyance failure Curl |
|---|---|---|---|---|---|---|---|---|
| Comparative Example 5 | A (22%) | D (36) | 20 | 56 | D (18.0%) | D | C | C |

INDUSTRIAL APPLICABILITY

By using the fixing method and fixing device of the present invention, images each having a suppressed sense of difference in gloss between the image and a recording medium, the images each having high gloss that is uniform irrespective of a toner mounting amount on a recording medium, can be stably and continuously obtained at a relatively high recording medium conveying speed.

This application claims priority from Japanese Patent Application No. 2004-130276 filed Apr. 26, 2004, which is hereby incorporated by reference herein.

The invention claimed is:

1. A fixing method comprising:

heat-pressure-fixing an unfixed toner image formed on a recording medium by using fixing means, wherein the unfixed toner image is fixed when the recording medium passes through at least two fixing units arranged in series in a conveying direction of the recording medium, wherein a toner for forming the unfixed toner image comprises a toner containing a release agent, wherein the following formulas (1) and (2) are satisfied when a maximum temperature on the recording medium when the recording medium passes through a first fixing unit is denoted by T1, a maximum temperature on the recording medium when the recording medium passes through a second fixing unit is denoted by T2, a minimum temperature on the recording medium during a time period commencing on ejection of the recording medium from the first fixing unit and ending on entry of the recording medium into the second fixing unit is denoted by t, a flow tester softening temperature of the toner is denoted by Ts, and a flow starting temperature of the toner is denoted by Tfb:

$$T1>Tfb \quad \text{formula (1)}$$

$$T2>t>Ts \quad \text{formula (2),}$$

wherein the maximum temperature T1 on a recording medium when the recording medium passes through a first fixing unit is 110 to 160° C., and the maximum temperature T2 on the recording medium when the recording medium passes through a second fixing unit is 140 to 190° C., wherein a peak temperature of a maximum endothermic peak is in a range of 60 to 140° C. in an endothermic curve in differential scanning calorimetry on the toner, and wherein the first fixing unit is a belt nip fixing type fixing unit, and the second fixing unit is a roller nip fixing type fixing unit.

2. The fixing method according to claim 1, wherein, when a flow tester ½ method melting temperature of the toner is denoted by T½, T½ and T2 satisfy the following formula (3):

$$T2>T½ \quad \text{formula (3).}$$

3. A fixing device comprising:

fixing means for heat-pressure-fixing an unfixed toner image formed on a recording medium, the fixing means comprising fixing units which are heat-pressure-fixing type devices, wherein the unfixed toner image is fixed when the recording medium passes through at least two of the fixing units arranged in series in a conveying direction of the recording medium, wherein a toner for forming the unfixed toner image comprises a toner containing a release agent, wherein the following formulas (1) and (2) are satisfied when a maximum temperature on the recording medium when the recording medium passes through a first fixing unit is denoted by T1, a maximum temperature on the recording medium when the recording medium passes through a second fixing unit is denoted by T2, a minimum temperature on the recording medium during a time period commencing on ejection of the recording medium from the first fixing unit and ending on entry of the recording medium into the second fixing unit is denoted by t, a flow tester softening temperature of the toner is denoted by Ts, and a flow starting temperature of the toner is denoted by Tfb:

$$T1>Tfb \quad \text{formula (1)}$$

$$T2>t>Ts \quad \text{formula (2)}$$

wherein the maximum temperature T1 on a recording medium when the recording medium passes through a first fixing unit is 110 to 160° C., and the maximum temperature T2 on the recording medium when the recording medium passes through a second fixing unit is 140 to 190° C., wherein a peak temperature of a maximum endothermic peak is in a range of 60 to 140° C. in an endothermic curve in differential scanning calorimetry on the toner, and wherein the first fixing unit is a belt nip fixing type fixing unit, and the second fixing unit is a roller nip fixing type fixing unit.

4. The fixing device according to claim 3, wherein, when a flow tester ½ method melting temperature of the toner is denoted by T½, T½ and T2 satisfy the following formula (3):

$$T2>T½ \quad \text{formula (3).}$$

* * * * *